US009050795B2

(12) United States Patent
Ueshima

(10) Patent No.: US 9,050,795 B2
(45) Date of Patent: Jun. 9, 2015

(54) IMAGE RECORDING APPARATUS, CONTROL METHOD THEREOF, AND RECORDING MEDIUM

(71) Applicant: FUJIFILM CORPORATION, Tokyo (JP)

(72) Inventor: Masashi Ueshima, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 14/242,966

(22) Filed: Apr. 2, 2014

(65) Prior Publication Data

US 2014/0300656 A1 Oct. 9, 2014

(30) Foreign Application Priority Data

Apr. 3, 2013 (JP) ..... 2013-077792

(51) Int. Cl.
*B41J 29/38* (2006.01)
*B41J 29/393* (2006.01)
(Continued)

(52) U.S. Cl.
CPC *B41J 2/12* (2013.01); *B41J 2/0451* (2013.01); *B41J 2/1652* (2013.01); *B41J 2/2139* (2013.01); *B41J 2/2142* (2013.01)

(58) Field of Classification Search
CPC ..... B41J 2/2139; B41J 2/2142; B41J 2/12; B41J 2/0451; B41J 2/1652; B41J 2/16579
USPC ..... 347/12, 14, 19
See application file for complete search history.

(56) References Cited

U.S. PATENT DOCUMENTS 6,412,903 B1 * 7/2002 Lee et al. ..... 347/19
6,669,321 B2 * 12/2003 Yoshida ..... 347/19
(Continued)

FOREIGN PATENT DOCUMENTS

JP 2007-015397 A 1/2007
JP 2008-217310 A 9/2008
(Continued)

OTHER PUBLICATIONS

The extended European search report issued by the European Patent Office on Sep. 11, 2014, which corresponds to European Patent Application No. 14163190.3 - 1701 and is related to U.S. Appl. No. 14/242,966.
(Continued)

*Primary Examiner* — Jannelle M Lebron
(74) *Attorney, Agent, or Firm* — Studebaker & Brackett PC

(57) ABSTRACT

A method for controlling an image recording apparatus includes: detecting a defective recording element out of a plurality of recording elements on a recording head for recording an image on a recording medium; performing a correction processing including suspension of an output of the defective recording element and increase of an output of a recording element at least adjacent to the defective recording element according to a detection result; determining whether or not an image defect is caused in the image by the suspension of output of the defective recording element, before performing the correction processing, according to the detection result; selecting a forced recording element that is forced to output ink out of defective recording elements when it is determined that the image defect is caused; and suspending the output of the defective recording element other than the forced recording element when the forced recording element is selected.

14 Claims, 23 Drawing Sheets

(51) Int. Cl.

| | |
|---|---|
| ***B41J 2/12*** | (2006.01) |
| ***B41J 2/045*** | (2006.01) |
| ***B41J 2/165*** | (2006.01) |
| ***B41J 2/21*** | (2006.01) |

(56) References Cited

U.S. PATENT DOCUMENTS

| | | | | |
|---|---|---|---|---|
| 8,646,869 | B2 * | 2/2014 | Yamazaki | 347/19 |
| 2006/0197793 | A1 | 9/2006 | Takahashi et al. | |

FOREIGN PATENT DOCUMENTS

| | | | |
|---|---|---|---|
| JP | 2012-071474 | A | 4/2012 |
| JP | 2012-206323 | A | 10/2012 |

OTHER PUBLICATIONS

An Office Action; "Notification of Reasons for Rejection," issued by the Japanese Patent Office on Apr. 23, 2015, which corresponds to Japanese Patent Application No. 2013-077792 and is related to U.S. Appl. No. 14/242,966; with English language partial translation.

* cited by examiner

FIG.4

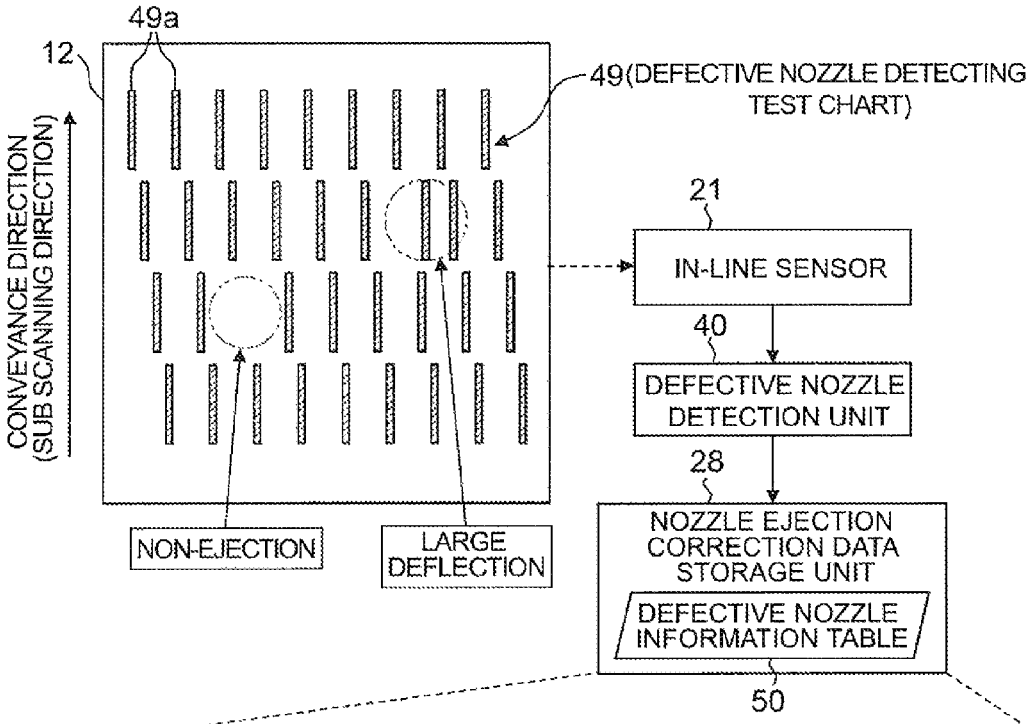

DEFECTIVE NOZZLE INFORMATION TABLE

| | DETECTION DATE AND TIME | NOZZLE NUMBER | DEFECTIVE NOZZLE TYPE | EJECTION DEFLECTION AMOUNT |
|---|---|---|---|---|
| FIRST DEFECTIVE NOZZLE DETECTION INFORMATION | T1 | No4 | NATURAL NON-EJECTION | - |
| | T1 | No7 | EJECTION LARGE DEFLECTION | X1 |
| | T1 | No21 | EJECTION LARGE DEFLECTION | X2 |
| | ⋮ | ⋮ | ⋮ | ⋮ |
| SECOND DEFECTIVE NOZZLE DETECTION INFORMATION | T2 | No4 | NATURAL NON-EJECTION | - |
| | T2 | No7 | EJECTION LARGE DEFLECTION | X3 |
| | T2 | No8 | EJECTION LARGE DEFLECTION | X4 |
| | T2 | No21 | EJECTION LARGE DEFLECTION | X2 |
| | ⋮ | ⋮ | ⋮ | ⋮ |
| ⋮ | T3 | No4 | NATURAL NON-EJECTION | - |

IMAGE RECORDING APPARATUS, CONTROL METHOD THEREOF, AND RECORDING MEDIUM

BACKGROUND OF THE INVENTION

1. Field of the Invention

The presently disclosed subject matter relates to an image recording apparatus which can suppress occurrence of an image defect caused by a defective recording element, and a control method thereof.

2. Description of the Related Art

There has been known an ink-jet recording apparatus (an image recording apparatus) which forms an image on a recording medium by ejecting ink from a plurality of ink-ejecting nozzles (simply referred to as a nozzle below) provided on a recording head. In the ink-jet recording apparatus, there is generated a non-ejection nozzle which cannot eject ink due to clogging or breakdown over time. When the non-ejection nozzle as described above is generated, stripe unevenness (a white stripe or the like) caused by the non-ejection nozzle occurs in a single-pass-type ink-jet recording apparatus when a recorded image is observed. The stripe unevenness is caused not only by the non-ejection nozzle described above, but also by an "ejection largely-deflected nozzle" having a large amount of ink flight deflection. Therefore, a technique for detecting the generation of a defective nozzle such as the non-ejection nozzle and the ejection largely-deflected nozzle, and a technique for suppressing the occurrence of stripe unevenness caused by the defective nozzle have been developed.

For example, an image recording apparatus according to Japanese Patent No. 4915252 detects a defective nozzle by recording a test chart on a recording medium by an ink-jet head, and analyzing a reading result obtained by reading the test chart by an optical reading device such as an in-line sensor.

An image recording apparatus according to Japanese Patent Application Laid-Open No. 2012-071474 detects a defective nozzle in basically the same method as that of Japanese Patent No. 4915252, and thereafter suppresses the occurrence of stripe unevenness by performing so-called non-ejection correction in which ink ejection from the defective nozzle is prohibited, and the output densities of normal adjacent nozzles adjacent to the defective nozzle are increased. The image recording apparatus according to Japanese Patent Application Laid-Open No. 2012-071474 also determines a correction parameter for non-ejection correction that varies with a difference in a landing interference pattern based on an arrangement form of nozzles on an ink-jet head, and correspondence information indicating a correspondence relation between a plurality of types of landing interference patterns and respective nozzles. In the image recording apparatus, input image data is modified so as to compensate for the output of the defective nozzle by use of nozzles other than the defective nozzle by referring to the correction parameter for non-ejection correction based on the positional information of the defective nozzle and performing a corrective calculation of the input image data using the correction parameter.

SUMMARY OF THE INVENTION

However, in the image recording apparatus according to Japanese Patent Application Laid-Open No. 2012-071474, for example, when two defective nozzles are adjacent to each other, a sufficient ink amount or a sufficient ink dot size cannot be obtained even when the output densities of normal adjacent nozzles adjacent to the two defective nozzles are increased. As a result, the stripe unevenness cannot be sufficiently corrected. Depending on the design of an image such as a line drawing, there occurs an image defect that the line drawing cannot be recorded when a defective nozzle corresponding to the line drawing is made to eject no ink.

An object of the presently disclosed subject matter is to provide an image recording apparatus which can reduce an image defect occurring when a defective nozzle is made to eject no ink at the time of non-ejection correction processing, and a control method thereof.

To achieve an object of the presently disclosed subject matter, an image recording apparatus includes: a recording control unit configured to record an image on a recording medium by a recording head having a plurality of recording elements while relatively moving the recording head and the recording medium; a defective recording element detection unit configured to detect a defective recording element out of the plurality of recording elements; a correction processing unit configured to perform a correction processing including suspension of an output of the defective recording element and increase of an output of a recording element at least adjacent to the defective recording element according to a detection result of the defective recording element detection unit; a determination unit configured to determine whether or not an image defect is caused in the image by the suspension of output of the defective recording element, before the correction processing by the correction processing unit, according to the detection result of the defective recording element detection unit; a selection unit configured to select a forced recording element that is forced to output ink out of defective recording elements detected by the defective recording element detection unit when the determination unit determines that the image defect is caused; and a control unit configured to cause the correction processing unit to suspend the output of the defective recording element other than the forced recording element when the selection unit selects the forced recording element.

In accordance with the presently disclosed subject matter, when it is determined that the image defect caused by the output suspension of the defective recording element occurs in the image before the correction processing, the forced recording element is selected out of the defective recording elements, and the output of the forced recording element is continued. Accordingly, the image quality of the recorded image can be improved as compared to a case in which the outputs of all the defective recording elements are suspended.

The determination unit may determine whether or not the image defect is caused based on whether a pattern of the defective recording elements detected by the defective recording element detection unit falls under a correction performance non-guaranteed pattern in which the image defect is caused, and the selection unit may select the forced recording element out of the defective recording elements based on a predetermined forced recording element selection rule. Accordingly, the image quality of the recorded image can be improved as compared to the case in which the outputs of all the defective recording elements are suspended.

The determination unit may determine that the pattern of the defective recording elements falls under the correction performance non-guaranteed pattern when a plurality of concentrated defective recording elements, recording positions of which on the recording medium are adjacent to or close to each other, are included in the defective recording elements. When the concentrated defective recording elements are included in the defective recording elements, the forced recording element is selected out of the concentrated defective recording elements, and the output of the forced recording element is continued. The image quality of the recorded image can be thereby improved.

When a distance between a first defective recording element and a second defective recording element included in the defective recording elements is m, and a range in which a correction processing corresponding to one of the first defective recording element and the second defective recording element by the correction processing unit affects a correction processing corresponding to another of the first and second defective recording elements is n, the determination unit may determine that the first defective recording element and the second defective recording element in a positional relationship satisfying $2n \geq m$ are the concentrated defective recording elements. The existence of the concentrated defective recording elements can be uniformly determined.

The image recording apparatus may further include a storage unit configured to store the detection result of the defective recording element detection unit, wherein the selection unit may select the forced recording element based on the detection result stored in the storage unit and the forced recording element selection rule.

The detection result may include information indicating detection timings of the defective recording elements, and in the forced recording element selection rule, one detected later out of a first concentrated defective recording element and a second concentrated defective recording element included in the respective concentrated defective recording elements may be preferentially selected as the forced recording element. Various image quality correction processing (density unevenness correction processing or the like) are likely to be already applied to one detected earlier out of the first and second concentrated defective recording elements. Thus, the one detected earlier can be excluded from a candidate of the forced recording element.

The recording elements eject ink, and when ejection deflection of the ink occurs in the defective recording elements, the detection result may include information indicating temporal stabilities of magnitudes of the ejection deflection of the defective recording elements, and in the forced recording element selection rule, one, the magnitude of the ejection deflection of which has a higher temporal stability, out of a first concentrated defective recording element and a second concentrated defective recording element included in the respective concentrated defective recording elements may be preferentially selected as the forced recording element. By ejecting ink from the one, an ejection deflection amount of which has a higher temporal stability, and thereby performing image recording, the temporal stability of the image quality of the recorded image can be improved, and various image quality correction processing (density unevenness correction processing or the like) can also be stably applied.

The recording elements eject ink, and when ejection deflection of the ink occurs in the defective recording elements, the detection result may include information indicating magnitudes of the ejection deflection of the defective recording elements, and in the forced recording element selection rule, one having a smaller magnitude of the ejection deflection out of a first concentrated defective recording element and a second concentrated defective recording element included in the respective concentrated defective recording elements may be preferentially selected as the forced recording element. By ejecting ink from the one having a smaller ejection deflection magnitude out of the first and second concentrated defective recording elements, interference with a recording element in the vicinity thereof is decreased, and correction close to design is enabled.

The recording elements eject ink, and when the defective recording elements include a defective recording element which cannot eject the ink and a defective recording element in which ejection deflection of the ink occurs, the detection result may include information indicating types of the defective recording elements, information indicating detection timings of the defective recording elements, and information indicating a magnitude of the ejection deflection of the defective recording element in which the ejection deflection occurs and a temporal stability thereof, and the forced recording element selection rule may include a first selection rule that the concentrated defective recording element in which the ejection deflection occurs out of the respective concentrated defective recording elements is preferentially selected as the forced recording element, a second selection rule that when the ejection deflection occurs in a plurality of concentrated defective recording elements, one detected later out of a first concentrated defective recording element and a second concentrated defective recording element included therein is preferentially selected as the forced recording element, a third selection rule that when detection timings of the first concentrated defective recording element and the second concentrated defective recording element are a same, one, the magnitude of the ejection deflection of which has a higher temporal stability, is preferentially selected as the forced recording element, and a fourth selection rule that when the temporal stabilities are the same, one having a smaller magnitude of the ejection deflection is preferentially selected as the forced recording element. The forced recording element can be selected in consideration of the type of the concentrated defective recording element, the detection date and time, the temporal stability, and the magnitude of the ejection deflection.

When a defective recording element excluded from an object of the suspension of output according to a design of the image is included in the defective recording elements, the determination unit may determine that the pattern of the defective recording elements falls under the correction performance non-guaranteed pattern, and in the forced recording element selection rule, the defective recording element excluded from the object of the suspension of output according to the design may be selected as the forced recording element. The defective recording element excluded from the object of output suspension in relation to the design is selected as the forced recording element, and the output thereof is continued. Accordingly, the image quality of the recorded image can be improved as compared to the case in which the outputs of all the defective recording elements are suspended.

The image recording apparatus may further include a display unit configured to display warning information indicating that image recording is performed by the forced recording element when the selection unit selects the forced recording element. Accordingly, a user can identify that the image recording is performed by using the forced recording element. As a result, the user can be prompted to determine OK/NG of the image quality of the recorded image.

The warning information may include positional information indicating a position of the forced recording element in the recording head. Accordingly, the user can easily identify the position of the forced recording element in the recording head.

To achieve another object of the presently disclosed subject matter, a method for controlling an image recording apparatus includes: a defective recording element detection step of detecting a defective recording element out of a plurality of recording elements on a recording head for recording an image on a recording medium; a correction processing step of performing a correction processing including suspension of an output of the defective recording element and increase of an output of a recording element at least adjacent to the defective recording element according to a detection result in the defective recording element detection step; a determination step of determining whether or not an image defect is caused in the image by the suspension of output of the defective recording element, before the correction processing step, according to the detection result in the defective recording element detection step; a selection step of selecting a forced recording element that is forced to output ink out of defective recording elements detected in the defective recording element detection step when it is determined that the image defect is caused in the determination step; and a control step of suspending the output of the defective recording element other than the forced recording element in the correction processing step when the forced recording element is selected in the selection step.

To achieve another object of the presently disclosed subject matter, a program causes a computer to execute: a defective recording element detection step of detecting a defective recording element out of a plurality of recording elements by acquiring a reading result of a test chart from a test chart reading unit configured to read the test chart recorded on a recording medium by a recording head having the plurality of recording elements; a correction processing step of performing a correction processing including suspension of an output of the defective recording element and increase of an output of a recording element at least adjacent to the defective recording element according to a detection result in the defective recording element detection step; a determination step of determining whether or not an image defect is caused in the image by the output suspension of the defective recording element, before the correction processing step, according to the detection result in the defective recording element detection step; a selection step of selecting a forced recording element that is forced to output ink out of defective recording elements detected in the defective recording element detection step when it is determined that the image defect is caused in the determination step; and a control step of suspending the output of the defective recording element other than the forced recording element in the correction processing step when the forced recording element is selected in the selection step.

In accordance with the image recording apparatus, and the control method and the program thereof, the image defect occurring when the outputs of all the defective recording elements are suspended in the correction processing can be reduced.

BRIEF DESCRIPTION OF THE DRAWINGS

FIG. 4 is an explanatory view for explaining a process of detecting a defective nozzle;

DETAILED DESCRIPTION OF THE PREFERRED EMBODIMENTS

[Configuration of an Ink-Jet Printing System According to a First Embodiment]

Figure 1:
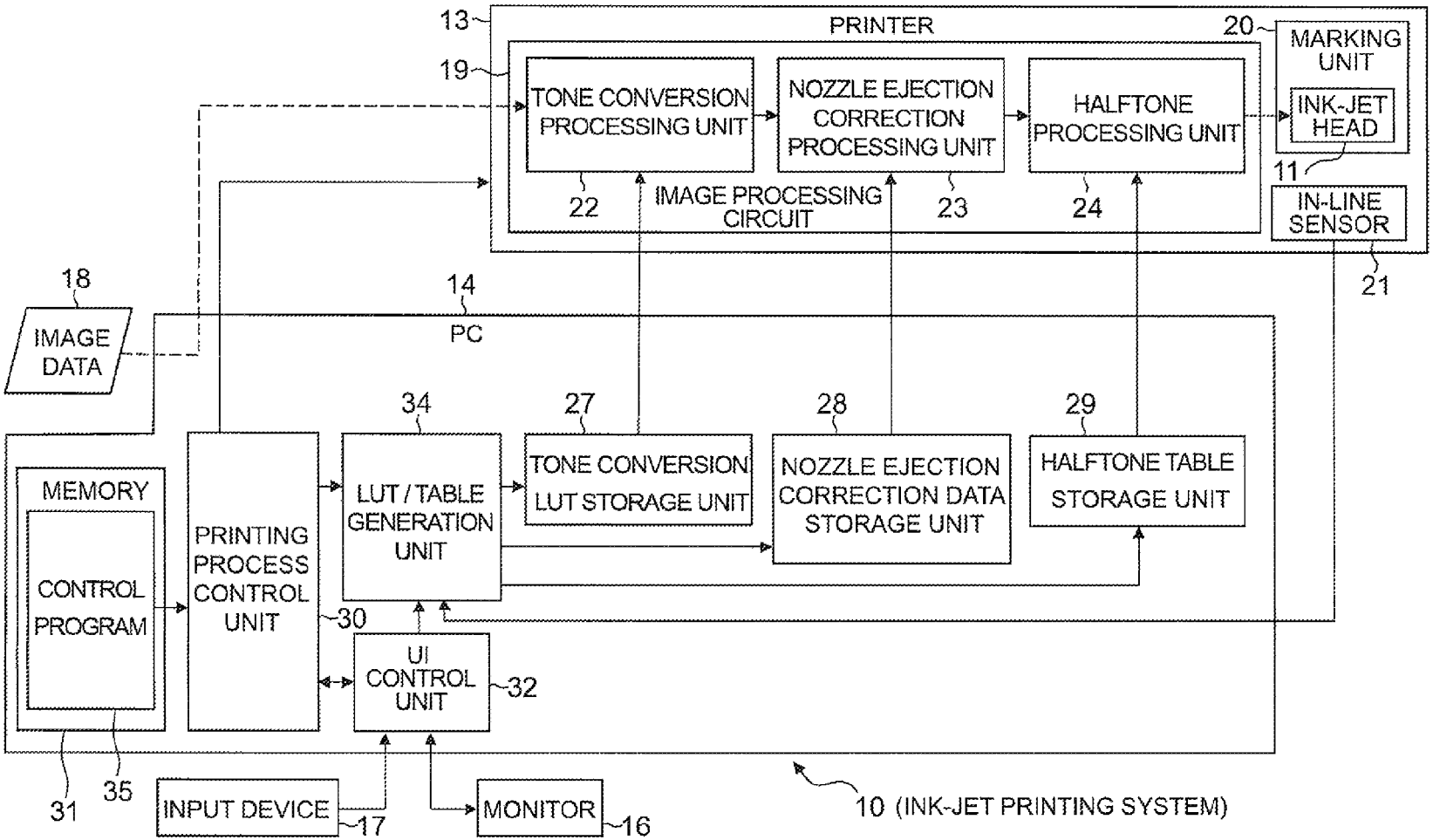
FIG. 1 is a schematic diagram of an ink-jet printing system according to a first embodiment.

As illustrated in FIG. 1, an ink-jet printing system (simply referred to as a printing system below) 10 corresponds to an image recording apparatus in the presently disclosed subject matter. The printing system 10 records an image in a single pass method by using an ink-jet head 11 corresponding to a recording head in the presently disclosed subject matter. That is, the printing system 10 records (also referred to as forms, prints, or draws) an image on an image recording region of a recording medium 12 at a predetermined recording resolution (e.g., 1,200 dpi) by performing an operation of relatively moving the recording medium 12 (see FIG. 3) with respect to the ink-jet head 11 only once. In the present embodiment, image recording is performed by using ink of four colors: cyan (C), magenta (M), yellow (Y), and black (B). A combination of the color of ink and the number of colors is not limited to that of the present embodiment.

The printing system 10 includes a printer 13, a computer body (represented as a "PC" below) 14, a monitor 16, an input device 17 or the like.

The printer 13 records an image on the recording medium 12 by using the ink-jet head 11 under control of the PC 14. The PC 14 functions as a control device which controls the operation of the printer 13, and also functions as a data management device which manages various data.

The monitor 16 and the input device 17 are connected to the PC 14, and function as a user interface of the PC 14. The monitor 16 displays an operation screen or the like of the printer 13 output from the PC 14. A keyboard, a mouse, a touch panel, a trackball or the like may be employed as the input device 17. A combination thereof may also be used. An operator operates the printer 13 by manipulating the input device 17 while looking at the operation screen or the like displayed on the monitor 16. When a print instruction is issued at the input device 17, image data 18 such as page data is transmitted to the printer 13 from the PC 14.

<Configuration of the Printer>

The printer 13 mainly includes an image processing circuit (an image processing board) 19, a marking unit (a recording control unit) 20, and an in-line sensor (a test chart reading unit) 21. The image processing circuit 19 generates a marking signal by performing signal processing such as tone conversion processing, nozzle ejection correction processing, and halftone processing on the image data 18 input from the PC 14. The image processing circuit 19 includes a tone conversion processing unit 22, a nozzle ejection correction processing unit 23, a halftone processing unit 24 or the like.

The tone conversion processing unit 22 performs processing to determine the property of density tone, that is, to determine at which color density an image is drawn when the image is recorded by the marking unit 20 described below. The tone conversion processing unit 22 converts the image data 18 so as to obtain a coloring property defined in the printer 13. For example, the tone conversion processing unit 22 converts a CMYK signal of the image data 18 to a $C_1M_1Y_1K_1$ signal, or converts respective signals of a C signal, an M signal, a Y signal, and a K signal individually to a $C_1$ signal, an $M_1$ signal, a $Y_1$ signal, and a $K_1$ signal.

The tone conversion processing unit 22 determines a conversion relationship of the signal conversion (the tone conversion) based on a tone conversion look-up table (LUT) (not illustrated) stored in a tone conversion LUT storage unit 27 within the PC 14. A plurality of tone conversion LUTs respectively optimized according to the types of the recording media 12 are stored in the tone conversion LUT storage unit 27. An appropriate LUT according to the type of the recording medium 12 is automatically set in the tone conversion processing unit 22. The tone conversion LUTs are prepared for each color of ink.

The nozzle ejection correction processing unit 23 corrects the output density of each nozzle 25 (a recording element, see FIG. 7) of the ink-jet head 11 so as to correct unevenness in the image recorded on the recording medium 12 by the ink-jet head 11. The "output density" here corresponds to the output of the recording element in the presently disclosed subject matter, and the correction of the output density means correction of an ink ejection amount. The "unevenness in the image" here means stripe unevenness caused by a defective nozzle $\mathbf{25}_{NG}$ (a defective recording element, see FIG. 7) such as a non-ejection nozzle and an ejection largely-deflected nozzle.

The nozzle ejection correction processing unit 23 corrects the output density of each nozzle 25 by performing signal conversion processing on an image signal input from the tone conversion processing unit 22 based on various correction LUTs in a nozzle ejection correction data storage unit 28 within the PC 14. The signal conversion processing by the nozzle ejection correction processing unit 23 is performed on each CMYK signal or on each of the signals with different colors similarly to the aforementioned tone conversion processing. Although the nozzle ejection correction processing unit 23 also corrects density unevenness caused by variations in ejection properties (recording properties) of the respective nozzles 25, the specific description of the correction of the density unevenness and a configuration related to the correction is omitted so as not to complicate the description.

The halftone processing unit 24 performs halftone processing to convert, in a pixel unit, a multi-tone (e.g., 8 bits=256 tones per color) image signal to a binary signal indicative of whether or not to eject ink, or a multi-valued signal indicative of which type of droplet is ejected when an ink diameter (a droplet size) can be selected from a plurality of diameters (sizes). As the halftone processing, a dithering method, an error diffusion method, a density pattern method or the like may be applied. For example, the halftone processing unit 24 converts a multi-tone signal input from the nozzle ejection correction processing unit 23 to a four-valued marking signal of "eject large-droplet ink," "eject middle-droplet ink," "eject small-droplet ink," and "eject no ink." The signal conversion by the halftone processing unit 24 is executed based on a halftone table (not illustrated) stored in a halftone table storage unit 29 within the PC 14.

The marking unit 20 includes the ink-jet head 11 for each of the colors of CMYK, and a relative moving mechanism (e.g., each drum in FIG. 22) which relatively moves the ink-jet head 11 and the recording medium 12. The plurality of ink-ejecting nozzles 25 are arranged over a length corresponding to the maximum width of an image formation region of the recording medium 12 on an ink ejection surface (a nozzle surface) of each of the ink-jet heads 11.

Driving of the ink-jet head 11 is controlled by a head driver (not illustrated) based on a marking signal input from the halftone processing unit 24. That is, ink ejection from each of the nozzles 25 is controlled according to the four-valued signal. A large dot is recorded on the recording medium 12 by the large-droplet ink. A middle dot is recorded on the recording medium 12 by the middle-droplet ink. A small dot is recorded on the recording medium 12 by the small-droplet ink. Accordingly, a multi-tone image is recorded on the recording medium 12.

The in-line sensor 21 reads various test charts recorded on the recording medium 12 by the ink-jet head 11. For example, a CCD (Charge Coupled Device) line sensor may be used as the in-line sensor 21. The ejection property (e.g., a recording density, a landing position error) of each of the nozzles 25, and the defective nozzle $\mathbf{25}_{NG}$ can be detected based on the reading result of the test charts by the in-line sensor 21.

<Configuration of the PC>

The PC 14 includes a printing process control unit 30, a memory 31, a user interface (UI) control unit 32, and an LUT/table generation unit 34 in addition to the aforementioned respective storage units 27 to 29. The respective units are configured by hardware or software of the PC 14, or a combination thereof.

The printing process control unit 30 controls the operations of the respective units of the printer 13 and the PC 14 by executing a control program (corresponding to a program in the presently disclosed subject matter) 35 read out from the memory 31. To be more specific, the printing process control unit 30 controls various processes in the LUT/table generation unit 34 or the like, and also performs display control of the monitor 16 and control in response to an input command from the input device 17 in cooperation with the UI control unit 32.

The printing process control unit 30 also issues a test chart record command and a test chart read command to the printer 13. Upon receiving the commands, the printer 13 records the test charts, reads the test charts using the in-line sensor 21, and outputs the reading result to the PC 14.

The LUT/table generation unit 34 generates various image processing parameters of the tone conversion LUT, the correction LUT, and the halftone table upon receiving a control signal from the printing process control unit 30 and a command signal from the UI control unit 32.

<Configuration of the LUT/Table Generation Unit>

Figure 2:
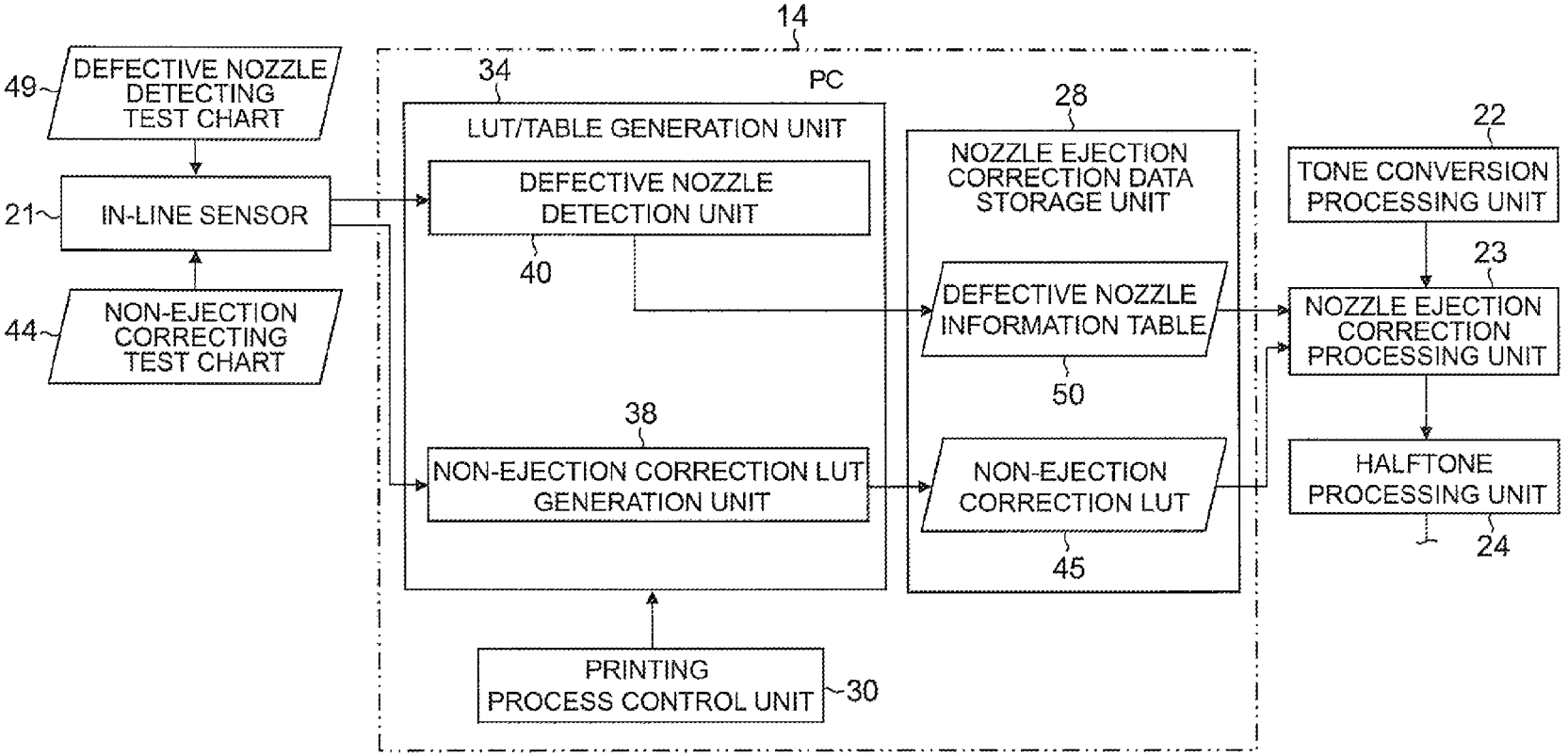
FIG. 2 is a block diagram illustrating the electrical configuration of a PC.

As illustrated in FIG. 2, the LUT/table generation unit 34 functions as a non-ejection correction LUT generation unit 38 and a defective nozzle detection unit (a defective recording element detection unit) 40 by executing the control program 35 upon receiving a command from the printing process control unit 30.

(Non-Ejection Correction LUT Generating Process)

Figure 3:
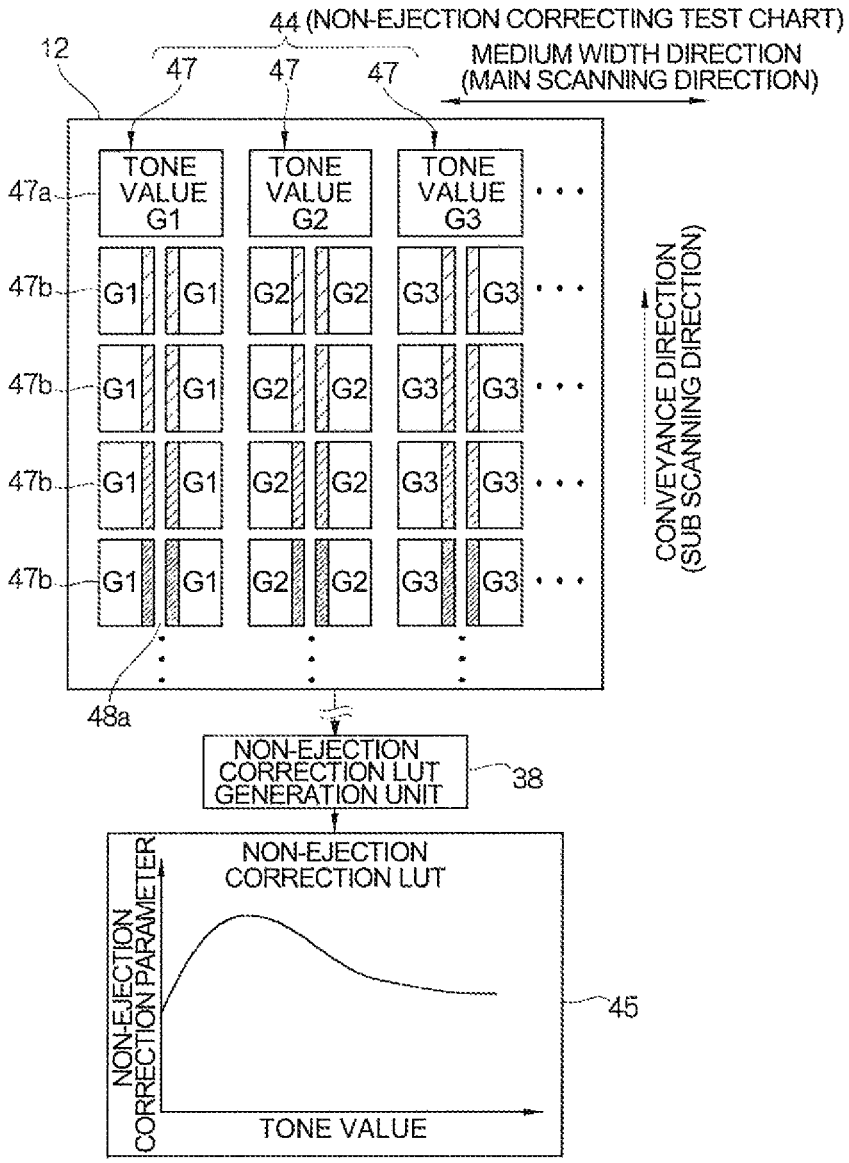
FIG. 3 is an explanatory view for explaining a process of generating a non-ejection correction LUT.

As illustrated in FIG. 3, the non-ejection correction LUT generation unit 38 generates a non-ejection correction LUT 45 based on a reading result of a non-ejection correcting test chart 44 read by the in-line sensor 21. The non-ejection correction LUT 45 may be generated (that is, a process from recording of the non-ejection correcting test chart 44 to generation of the non-ejection correction LUT 45) at any timing. The non-ejection correction LUT 45 is updated at an appropriate timing.

In the non-ejection correcting test chart 44, a plurality of patch lines 47 each composed of a plurality of patches of the same tone (G1, G2, G3, and so on) arranged along a conveyance direction (a sub-scanning direction) of the recording medium 12 are arranged in a direction (a main scanning direction) perpendicular to the conveyance direction. The respective patch lines 47 have different tone values. The tone value is gradually increased in the order of G1, G2, G3, and so on. Each of the patch lines 47 is composed of a reference patch 47*a* and a plurality of measurement patches 47*b*.

The reference patches 47*a* are uniform images respectively uniformly colored with tone values G1, G2, G3, and so on in each of the patch lines 47. The measurement patches 47*b* are formed by giving white-stripe unevenness 48*a* (a white stripe) simulating the existence of a non-ejection nozzle to the reference patch 47*a* at one position or more. A non-ejection correction parameter (a correction coefficient) is actually or simulatively applied (displayed as hatching in the drawing) to both sides of the white-stripe unevenness 48*a* in each of the measurement patches 47*b*. Non-ejection correction parameters having different values are applied to the respective measurement patches 47*b* in each of the patch lines 47.

The non-ejection correction LUT generation unit 38 selects a measurement patch 47*b*, to which a non-ejection correction parameter that achieves best visibility (allows the white-stripe unevenness 48*a* to be least noticeable) is applied, in each of the patch lines 47 based on the reading result of the non-ejection correcting test chart 44. Accordingly, the best non-ejection correction parameter is determined for each tone value (also referred to as a basic image setting value), and the non-ejection correction LUT 45 is obtained. The non-ejection correction LUT 45 in the drawing is merely one example of the non-ejection correction LUT. The non-ejection correction LUT generation unit 38 stores the non-ejection correction LUT 45 in the nozzle ejection correction data storage unit (simply abbreviated to a data storage unit below) 28.

(Defective Nozzle Detecting Process)

As illustrated in FIG. 4, the defective nozzle detection unit 40 detects the defective nozzle $\mathbf{25}_{NG}$ out of the respective nozzles 25 of the ink-jet head 11 based on a reading result of a defective nozzle detecting test chart 49 read by the in-line sensor 21.

A defective nozzle detecting process from generation of the defective nozzle detecting test chart 49 to output of defective nozzle information is executed based on a command from the printing process control unit 30. The defective nozzle detecting process is executed at any timing such as immediately after start-up of the printing system, immediately before an image recording process (also referred to as a printing process) based on the image data 18, and after recording of a predetermined number of sheets.

The defective nozzle detecting test chart 49 corresponds to a test chart in the presently disclosed subject matter. The defective nozzle detecting test chart 49 is composed of line patterns 49*a* respectively recorded on the recording medium 12 by the respective nozzles 25 of the ink-jet head 11 based on the command from the printing process control unit 30. In the defective nozzle detecting test chart 49, the line patterns 49*a* of adjacent nozzles 25 adjacent to each other are not overlapped with each other, so that an independent line pattern 49*a* (separated by each nozzle 25) is formed for each of all the nozzles 25 so as to be distinct from each other. Therefore, the defective nozzle detecting test chart 49 is a line pattern of so-called "1 on n off" type. The defective nozzle detecting test chart 49 is formed for each of the ink-jet heads 11 having different ink colors.

In the defective nozzle detecting test chart 49, a missing line pattern 49*a* corresponding to a natural non-ejection nozzle which cannot eject ink due to clogging or breakdown is generated over time as shown by "non-ejection" in a rectangular frame in the drawing. In the defective nozzle detecting test chart 49, a deflected line pattern 49*a* corresponding to an ejection largely-deflected nozzle, the amount of ink flight deflection of which is increased, is generated as shown by "large deflection" in a rectangular frame in the drawing. Therefore, the position of the defective nozzle $\mathbf{25}_{NG}$ such as the natural non-ejection nozzle and the ejection largely-deflected nozzle can be identified based on the reading result of the defective nozzle detecting test chart 49.

As for the ejection largely-deflected nozzle, an ejection deflection amount indicating the magnitude of ejection deflection can be obtained based on the reading result of the defective nozzle detecting test chart 49. The ejection deflection amount can be expressed by a difference between, for example, an actual recording position of the line pattern 49*a* corresponding to the ejection largely-deflected nozzle and a recording position of the line pattern 49*a* when it is assumed that the ejection deflection amount is not generated. The defective nozzle $\mathbf{25}_{NG}$ is not limited to the non-ejection nozzle and the largely-deflected nozzle, but includes an ejection malfunction nozzle where various ejection malfunctions occur.

The defective nozzle detecting test chart 49 may also include another pattern such as another line block (e.g., a block for checking a position error between line blocks) or a horizontal line (a partition line) for separating line blocks in addition to the line pattern of "1 on n off" type.

The defective nozzle detection unit 40 detects the defective nozzle $\mathbf{25}_{NG}$ by analyzing the reading result of the defective nozzle detecting test chart 49. Subsequently, the defective nozzle detection unit 40 generates defective nozzle information indicating the detection result of the defective nozzle $\mathbf{25}_{NG}$, and stores the defective nozzle information in a defective nozzle information table (a storage unit) 50 within the data storage unit 28.

The defective nozzle information (first defective nozzle information, second defective nozzle information, and so on) input from the defective nozzle detection unit 40 is cumulatively stored in the defective nozzle information table 50. The defective nozzle information includes information indicating "detection date and time" of each defective nozzle $\mathbf{25}_{NG}$, information indicating "nozzle number," information indicating "defective nozzle type," and information indicating "ejection deflection amount" when the defective nozzle $\mathbf{25}_{NG}$ is the ejection largely-deflected nozzle.

The "detection date and time" corresponds to information indicating a detection timing in the presently disclosed subject matter. The order of the detection timings of the respective defective nozzles $\mathbf{25}_{NG}$ or whether the detection timings are the same can be identified based on the information. The "nozzle number" is information indicating the positions of the respective defective nozzles $\mathbf{25}_{NG}$ within the ink-jet head 11. The "defective nozzle type" is information indicating the type of the defective nozzle $\mathbf{25}_{NG}$ (natural non-ejection, ejection large deflection or the like). The "ejection deflection amount" corresponds to information indicating the magnitude of ejection deflection in the presently disclosed subject matter. The ejection deflection amount of each ejection largely-deflected nozzle can be identified based on the information. A temporal change between the ejection deflection amounts of the ejection largely-deflected nozzles with the same nozzle number can be obtained based on the "nozzle number" and the "ejection deflection amount." Accordingly, the temporal stability of the ejection deflection amount of each ejection largely-deflected nozzle can be identified. Thus, the "nozzle number" and the "ejection deflection amount" are information indicating a temporal stability in the presently disclosed subject matter.

In the following, a series of processes including the recording of the defective nozzle detecting test chart 49 by the marking unit 20, the reading thereof by the in-line sensor 21, the detection of the defective nozzle $\mathbf{25}_{NG}$ by the defective nozzle detection unit 40, and the storage of the defective nozzle information in the defective nozzle information table 50 are called a "defective nozzle detecting process."

<Nozzle Ejection Correction Processing Unit>

Figure 5:
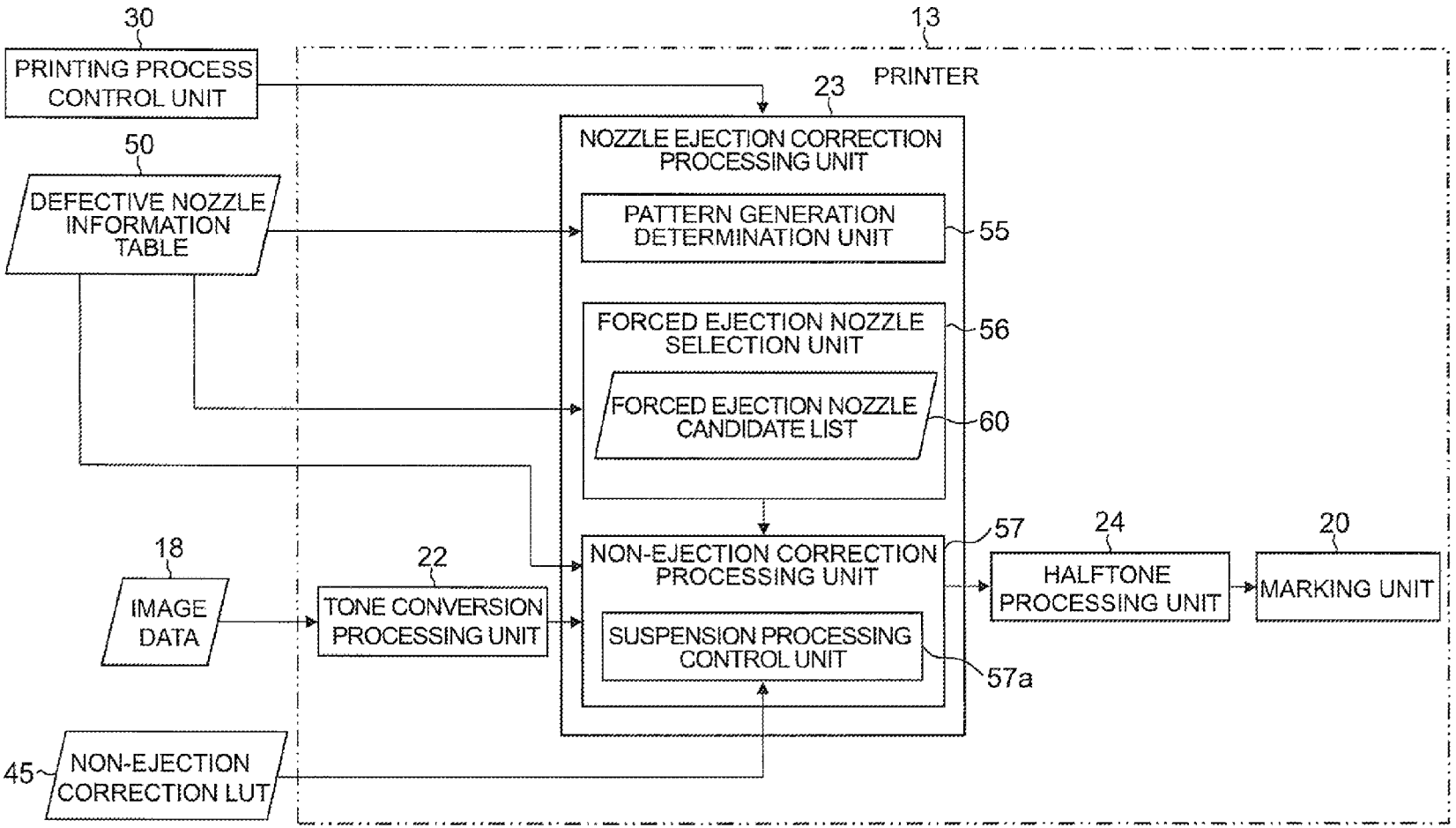
FIG. 5 is a block diagram illustrating the electrical configuration of a printer.

As illustrated in FIG. 5, the nozzle ejection correction processing unit 23 performs non-ejection correction processing on the image signal of the image data 18 subjected to the tone conversion processing in the tone conversion processing unit 22 based on the defective nozzle information table 50 and the non-ejection correction LUT 45.

Figure 6:
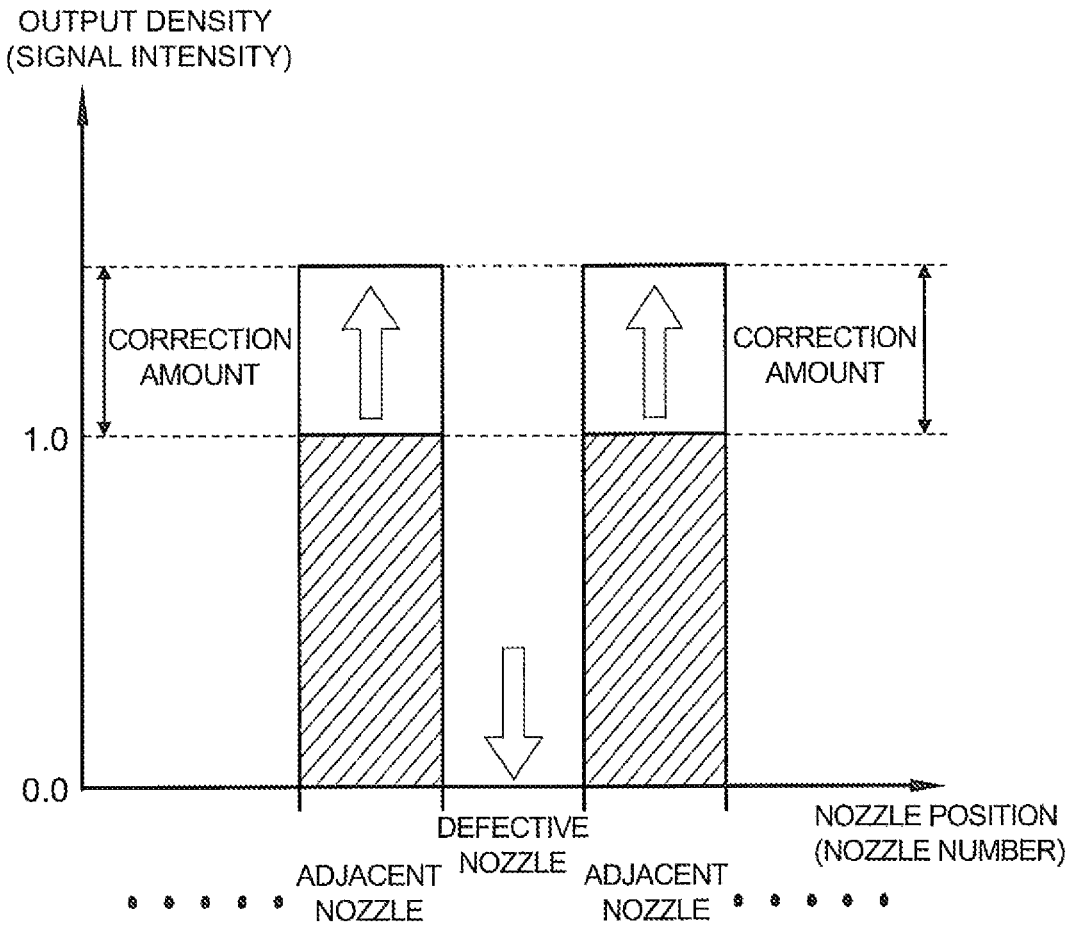
FIG. 6 is an explanatory view for explaining non-ejection correction processing.

To be more specific, the nozzle ejection correction processing unit 23 determines a defective nozzle $\mathbf{25}_{NG}$, the ink ejection of which is to be suspended, based on the defective nozzle information table 50, and performs output suspension processing (also referred to as non-ejection processing) to suspend the ink ejection (output) on the defective nozzle $\mathbf{25}_{NG}$ as illustrated in FIG. 6. The nozzle ejection correction processing unit 23 also performs signal conversion processing on an image signal corresponding to a normal nozzle 25 adjacent to the defective nozzle $\mathbf{25}_{NG}$ (referred to as an adjacent nozzle 25 below) such that the ink ejection amount of the adjacent nozzle 25 is increased by a correction amount defined by the non-ejection correction LUT 45.

Figure 7:
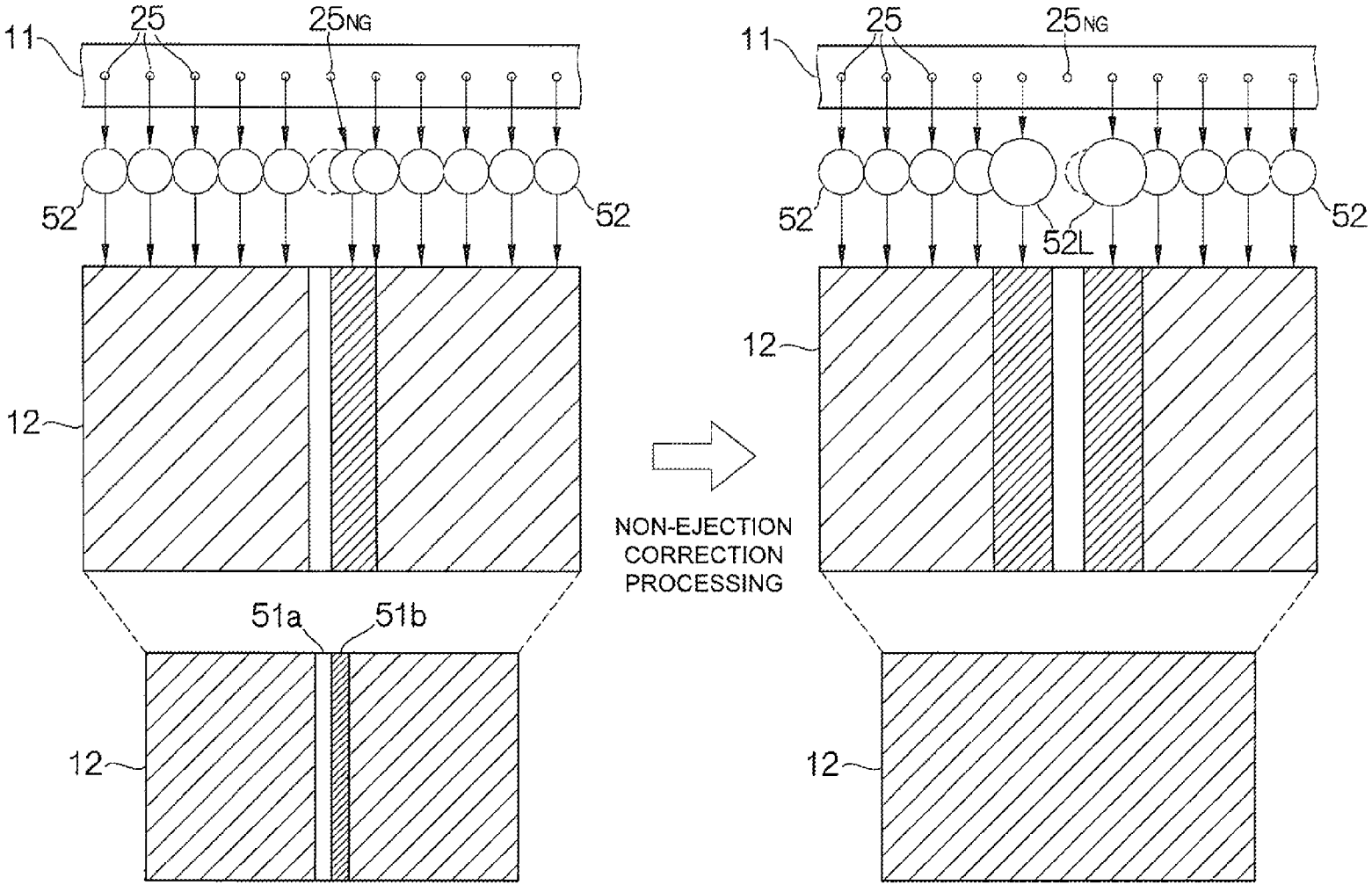
FIG. 7 is an explanatory view for explaining non-ejection correction processing when an ejection largely-deflected nozzle is generated.

For example, as illustrated in FIG. 7, when an ejection largely-deflected nozzle is generated as the defective nozzle $\mathbf{25}_{NG}$ in the respective nozzles 25, white-stripe unevenness 51*a* or black-stripe unevenness 51*b* occurs in a recorded image. In this case, the nozzle ejection correction processing unit 23 performs the non-ejection correction processing including the output suspension processing and the signal conversion processing illustrated in FIG. 6 respectively on the image signals corresponding to the defective nozzle $\mathbf{25}_{NG}$ (the ejection largely-deflected nozzle) and the adjacent nozzle 25. Accordingly, the ejection of ink 52 from the defective nozzle $\mathbf{25}_{NG}$ is suspended, and ink 52L having a larger ink amount and a larger ink dot size than those of the ink 52 is ejected from the adjacent nozzle 25. By suspending the ejection of the ink 52 from the defective nozzle $\mathbf{25}_{NG}$, the occurrence of the black-stripe unevenness 51*b* can be suppressed. By increasing the output density of the adjacent nozzle 25, the visibility of the white-stripe unevenness 51*a* can be lowered. A middle stage in FIG. 7 indicates dot arrangement on the recording medium 12, and a lower stage in FIG. 7 indicates how the recorded image recorded on the recording medium 12 is seen (the same applies to other similar drawings).

Figure 8:
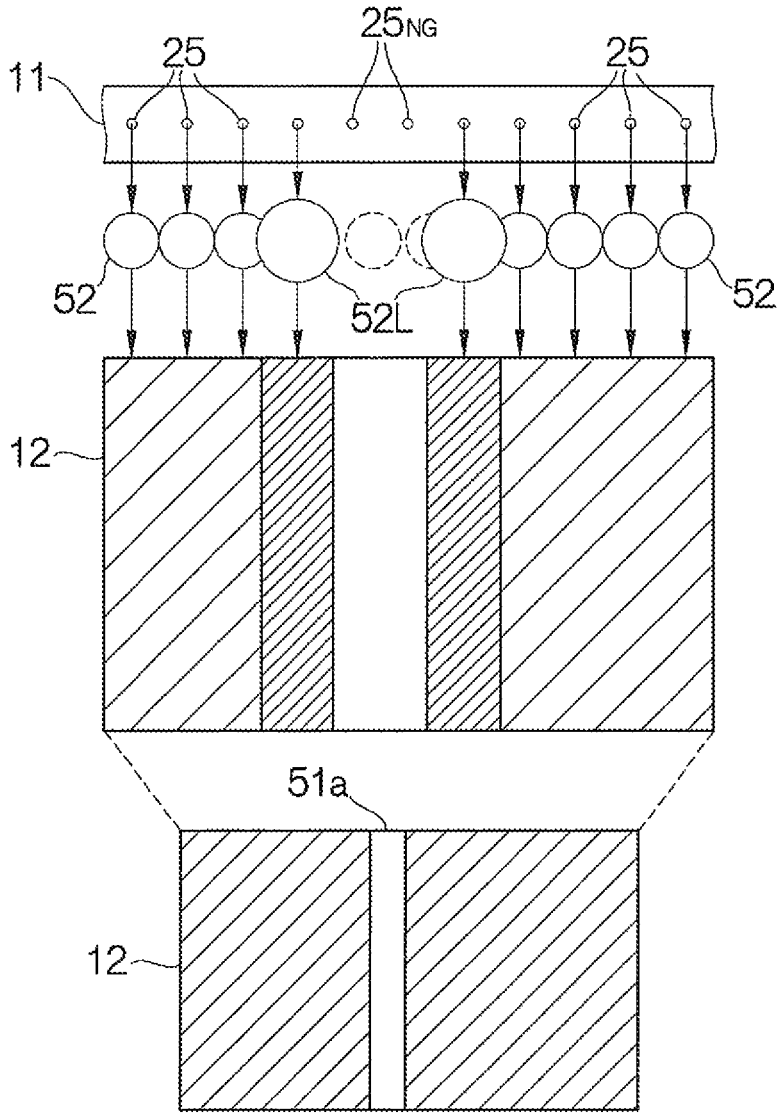
FIG. 8 is an explanatory view for explaining a failure case of non-ejection correction when ejection largely-deflected nozzles are generated adjacent to each other.

Meanwhile, as illustrated in FIG. 8, when two defective nozzles $\mathbf{25}_{NG}$ are adjacent to each other, the white-stripe unevenness 51*a* cannot be sufficiently corrected due to a lack of the ink amount or the ink dot size even when the output densities of adjacent nozzles 25 located on both sides of the two defective nozzles $\mathbf{25}_{NG}$ are increased. When a plurality of defective nozzles $\mathbf{25}_{NG}$ are concentrated as described above, the correction ability of the white-stripe unevenness 51*a* is insufficient due to the lack of the ink amount or the like when only the output densities of the adjacent nozzles 25 located on both sides thereof are increased. Thus, the white-stripe unevenness 51*a* is clearly visually recognized by a user. That is, when all of the defective nozzles $\mathbf{25}_{NG}$ are subjected to the output suspension processing at the time of the non-ejection correction processing, the white-stripe unevenness 51*a* (an image defect) is caused by the output suspension processing of the defective nozzles $\mathbf{25}_{NG}$. Thus, when the defective nozzles $\mathbf{25}_{NG}$ are concentrated, the nozzle ejection correction processing unit 23 causes some of the defective nozzles $\mathbf{25}_{NG}$ to eject the ink 52.

Returning to FIG. 5, the nozzle ejection correction processing unit 23 functions as a pattern generation determination unit (a determination unit) 55, a forced ejection nozzle selection unit (a selection unit) 56, and a non-ejection correction processing unit (an output correction unit) 57 by executing the control program 35 upon receiving a command from the printing process control unit 30. In the following, the pattern generation determination unit 55 is simply abbreviated to the "determination unit 55," and the forced ejection nozzle selection unit 56 is simply abbreviated to the "selection unit 56."

(Process of Determining Generation of a Correction Performance Non-Guaranteed Pattern)

The determination unit 55 determines whether or not a pattern of the defective nozzles $\mathbf{25}_{NG}$ is a correction performance non-guaranteed pattern CP (see FIG. 10) based on the defective nozzle information table 50. The correction performance non-guaranteed pattern (simply abbreviated to a non-guaranteed pattern below) CP is a pattern of the defective nozzles $\mathbf{25}_{NG}$ where the image defect (the white-stripe unevenness 51*a* or the like) occurs by the non-ejection correction processing, that is, the performance of the non-ejection correction processing is not guaranteed. The non-guaranteed pattern CP includes P (P is a natural number equal to or more than 2) defective nozzles $25_{NG}$, the recording positions of which on the recording medium 12 are adjacent to or close to each other in the direction (the main scanning direction) perpendicular to the recording medium conveyance direction (referred to as a concentrated defective nozzles $25_{NGX}$ below, concentrated defective recording elements). Therefore, the determination unit 55 determines whether or not the non-guaranteed pattern CP is generated based on whether the P concentrated defective nozzles $25_{NGX}$ are included in the defective nozzles $25_{NG}$ detected in the defective nozzle detecting process.

The concentrated defective nozzles $25_{NGX}$, the recording positions of which on the recording medium 12 are adjacent to or close to each other, are not limited to the ones, the nozzle positions of which are adjacent to or close to each other, as long as the recording positions are adjacent to or close to each other (the recording positions are apart from each other only by a few pixels). The defective nozzles $25_{NG}$ as an object of determination by the determination unit 55 are not limited to the latest defective nozzle $25_{NG}$ detected in the defective nozzle detecting process, but may also include one of the defective nozzles $25_{NG}$ detected in the past.

Figure 9:
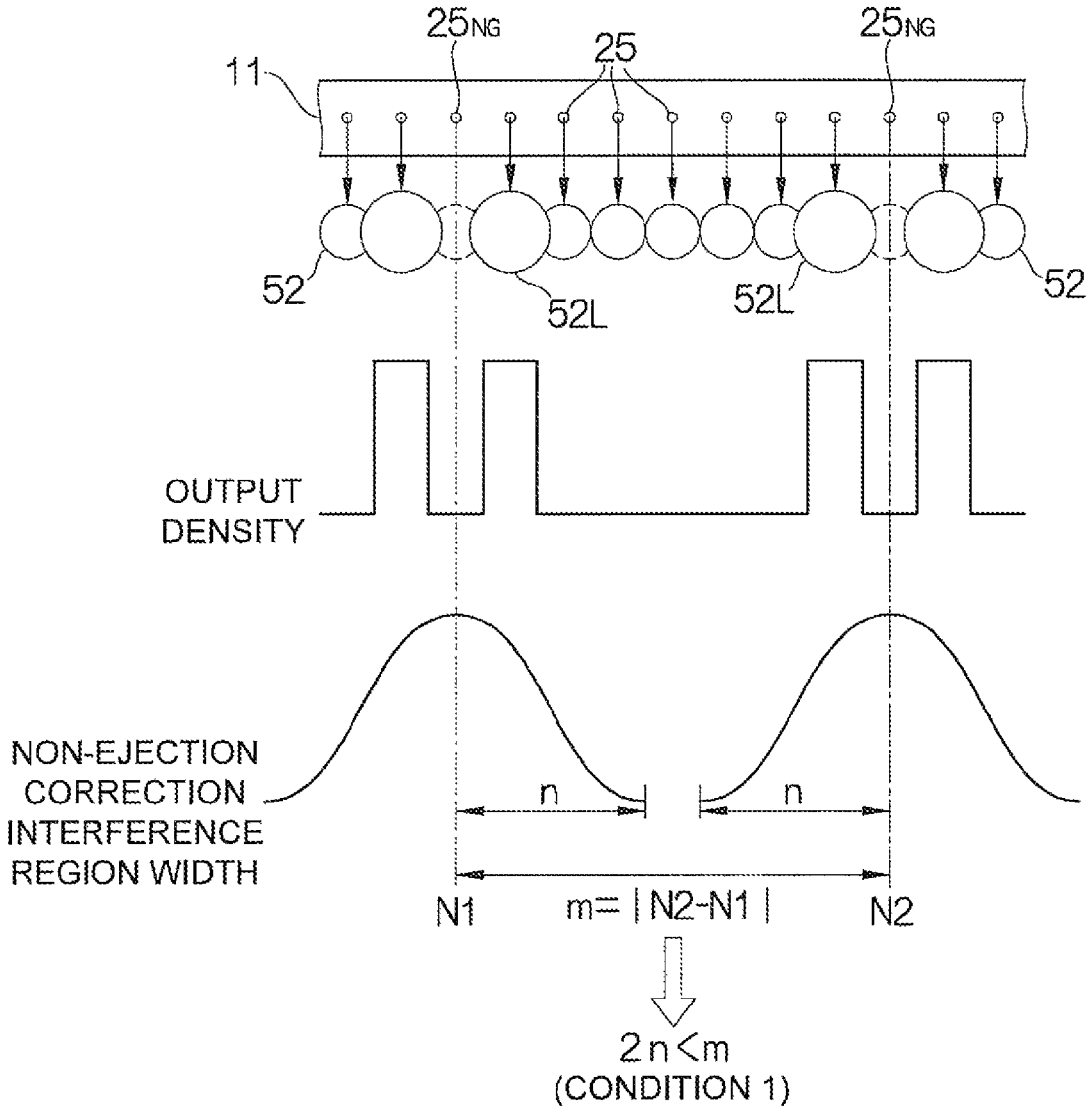
FIG. 9 is an explanatory view for explaining a case in which a positional relationship between first and second defective nozzles satisfies a condition 1.

As illustrated in FIG. 9, when the non-ejection correction processing on any first defective nozzle $25_{NG}$ included in the respective defective nozzles $25_{NG}$ and an adjacent nozzle 25 thereof affects the performance of the non-ejection correction processing on another second defective nozzle $25_{NG}$ and an adjacent nozzle 25 thereof, the determination unit 55 determines that the first and second defective nozzles $25_{NG}$ are adjacent to or close to each other. The first and second defective nozzles $25_{NG}$ correspond to a first defective recording element and a second defective recording element in the presently disclosed subject matter.

To be more specific, "affecting the performance of the non-ejection correction processing" means that the image quality of a recording region on the recording medium 12 corresponding to the first and second defective nozzles $25_{NG}$ is affected, that is, the white-stripe unevenness 51*a* is not sufficiently corrected as illustrated in FIG. 8. Therefore, in the determination unit 55, a single width n of a non-ejection correction interference region is defined for one defective nozzle $25_{NG}$, that is, each of the first and second defective nozzles $25_{NG}$ (the entire width of the non-ejection correction interference region is 2n+1 by counting the nozzle itself as well). The single width n of the non-ejection correction interference region indicates a range in which the non-ejection correction processing corresponding to one of the first and second defective nozzles $25_{NG}$ affects the performance of the non-ejection correction processing corresponding to the other. In other words, the single width n of the non-ejection correction interference region means that the performance of each non-ejection correction processing is affected when one of the first and second defective nozzles $25_{NG}$ is located at a position apart from the other by a distance of "2n"-nozzle. The single width n of the non-ejection correction interference region can be obtained in advance by an experiment or a simulation.

The determination unit 55 determines whether the first and second defective nozzles $25_{NG}$ fall under the concentrated defective nozzles $25_{NGX}$ or do not fall under the concentrated defective nozzles $25_{NGX}$ based on whether 2n<m is satisfied when a distance between the first and second defective nozzles $25_{NG}$ is m (nozzle). Here, m is the distance in the main scanning direction, and obtained from a difference (m=|N2−N1|) between a nozzle position N1 of the first defective nozzle $25_{NG}$ and a nozzle position N2 of the second defective nozzle $25_{NG}$ in the ink-jet head 11. The respective nozzle positions N1 and N2 are obtained from the nozzle numbers of the first and second defective nozzles $25_{NG}$. Although m and n are represented by the distance and the single width in a nozzle unit in the main scanning direction in the present embodiment, m and n may also be represented by a distance and a single width in a pixel unit in the main scanning direction.

When the positions of the first and second defective nozzles $25_{NG}$ satisfy the positional relationship of 2n<m (referred to as a "condition 1" below as needed), the first and second defective nozzles $25_{NG}$ are apart from each other by a distance not affecting the performance of each non-ejection correction processing. Therefore, the determination unit 55 determines that the first and second defective nozzles $25_{NG}$ do not fall under the concentrated defective nozzles $25_{NGX}$.

Figure 10:
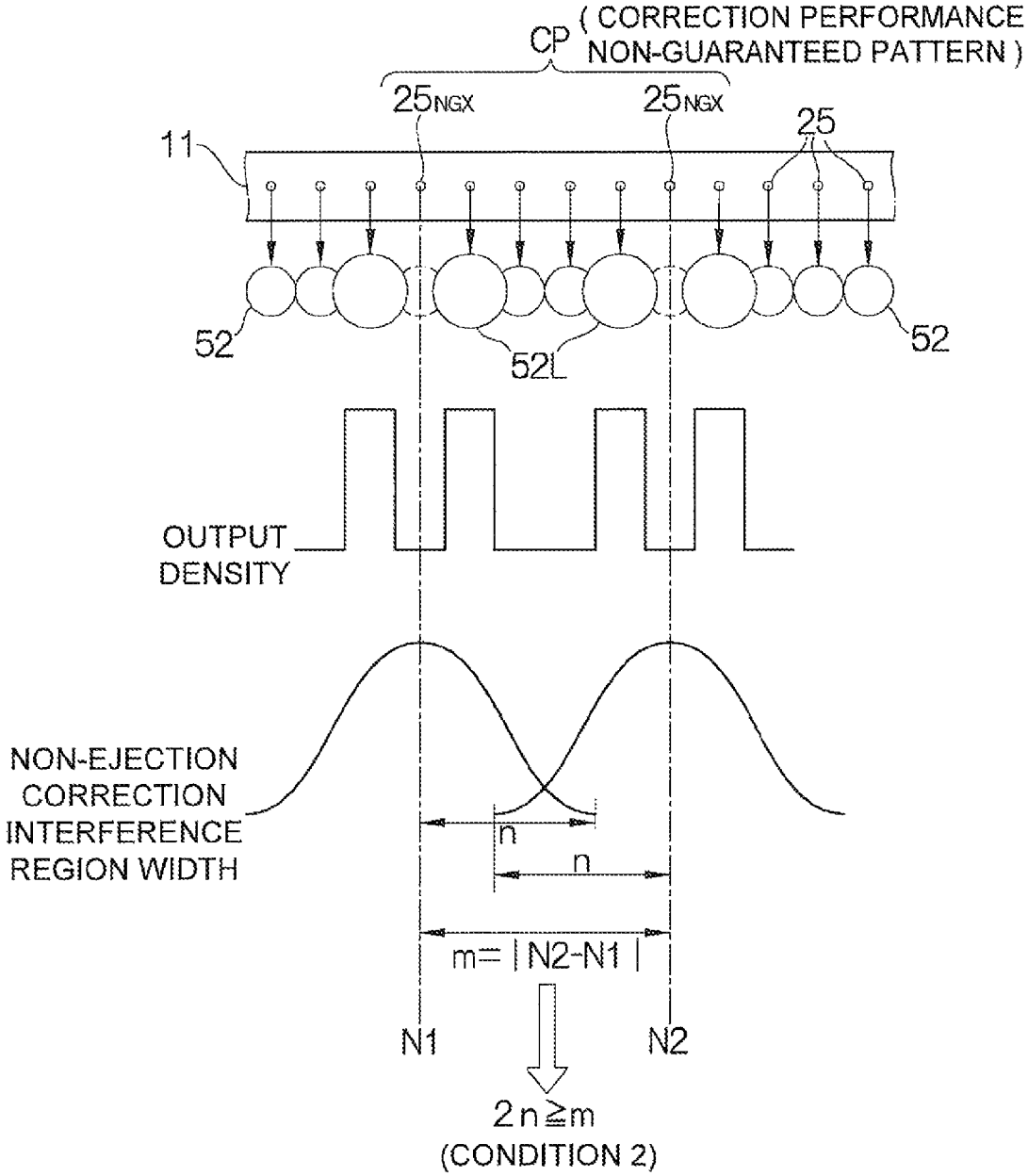
FIG. 10 is an explanatory view for explaining a case in which a positional relationship between the first and second defective nozzles satisfies a condition 2.

When the positions of the first and second defective nozzles $25_{NG}$ satisfy the positional relationship of 2n≥m (referred to as a "condition 2" below as needed) as illustrated in FIG. 10, the first and second defective nozzles $25_{NG}$ are located close enough to affect the performance of each non-ejection correction processing, that is, adjacent to or close to each other. Therefore, the determination unit 55 determines that the first and second defective nozzles $25_{NG}$ fall under the concentrated defective nozzles $25_{NGX}$. In this case, the determination unit 55 determines that the pattern of the defective nozzles $25_{NG}$ detected in the defective nozzle detecting process falls under the non-guaranteed pattern CP where the image defect (here, the white-stripe unevenness 51*a*) occurs.

Figure 11:
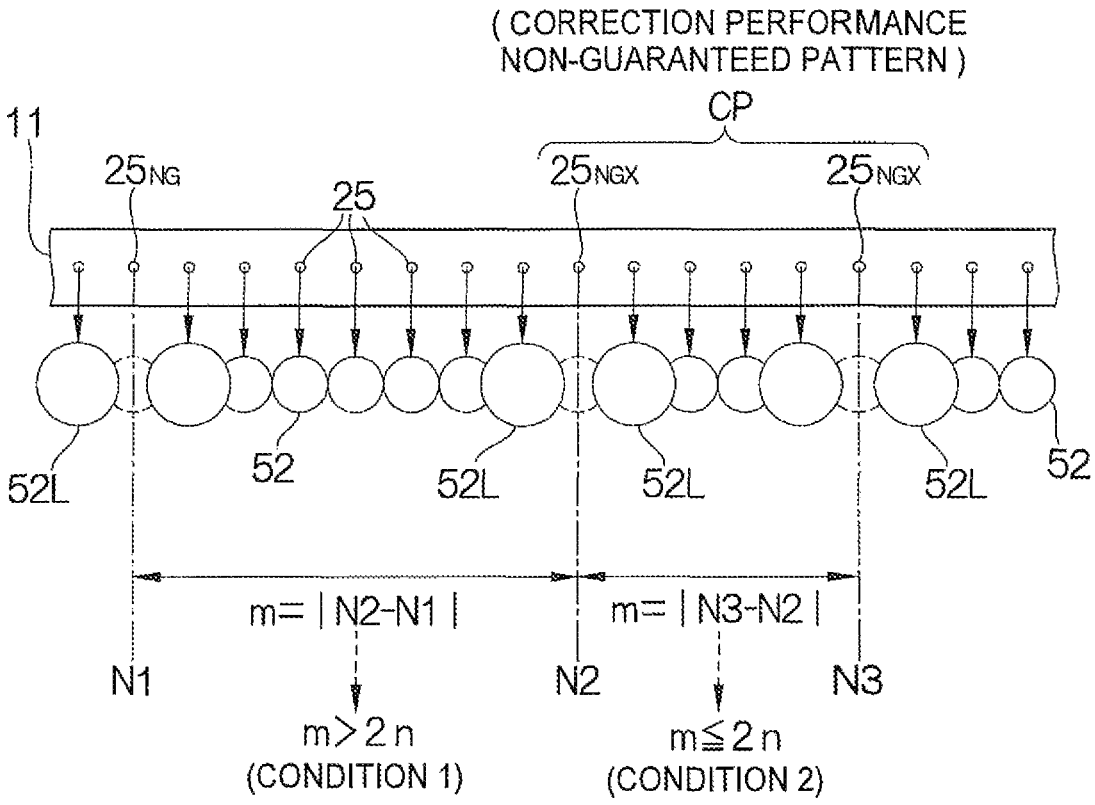
FIG. 11 is an explanatory view for explaining a process of determining generation of a correction performance non-guaranteed pattern when there exist three defective nozzles.

As illustrated in FIG. 11, the condition 1 is satisfied for the defective nozzles $25_{NG}$ located at the nozzle positions N1 and N2, so that the determination unit 55 determines that the two defective nozzles $25_{NG}$ do not fall under the concentrated defective nozzles $25_{NGX}$. Meanwhile, the condition 2 is satisfied for the defective nozzles $25_{NG}$ located at the nozzle positions N2 and N3, so that the determination unit 55 determines that the two defective nozzles $25_{NG}$ fall under the concentrated defective nozzles $25_{NGX}$. Here, when the condition 2 is satisfied between each of the defective nozzles $25_{NG}$ and at least another defective nozzle $25_{NG}$, the defective nozzles $25_{NG}$ are determined to be the concentrated defective nozzles $25_{NGX}$ by the determination unit 55. That is, when the defective nozzle $25_{NG}$ located at the nozzle position N2 does not satisfy the condition 2 with the defective nozzle $25_{NG}$ located at the nozzle position N1, but satisfies the condition 2 with the defective nozzle $25_{NG}$ located at the nozzle position N3, the defective nozzle $25_{NG}$ falls under the concentrated defective nozzles $25_{NGX}$. Therefore, in this case, the determination unit 55 determines that the pattern of the defective nozzles $25_{NG}$ detected in the defective nozzle detecting process falls under the non-guaranteed pattern CP.

The determination unit 55 similarly determines whether or not each of all the defective nozzles $25_{NG}$ stored in the defective nozzle information table 50 satisfies the condition 2 with any another defective nozzle $25_{NG}$. The determination unit 55 determines that the non-guaranteed pattern CP is generated when the condition 2 is satisfied at least one position, and determines that the non-guaranteed pattern CP is not generated when the condition 1 is satisfied at every position. Subsequently, the determination unit 55 outputs the determination result indicating whether the non-guaranteed pattern CP is generated to the selection unit 56. The determination unit 55 also reads out the nozzle numbers of the concentrated defective nozzles $25_{NGX}$ constituting the non-guaranteed pattern CP from the defective nozzle information table 50 when the non-guaranteed pattern CP is generated, and outputs the nozzle numbers to the selection unit 56.

(Forced Ejection Nozzle Selecting Process)

Returning to FIG. 5, the selection unit 56 selects a forced ejection nozzle 25A (see FIG. 14, a forced recording element) out of the defective nozzles $\mathbf{25}_{NG}$ detected in the defective nozzle detecting process based on the determination result of the determination unit 55. To be more specific, the selection unit 56 selects Q (Q is a natural number satisfying $1 \leq Q < P$) forced ejection nozzles 25A when the non-guaranteed pattern CP composed of the P concentrated defective nozzles $\mathbf{25}_{NGX}$ is generated.

First, the selection unit 56 registers the nozzle numbers of all the concentrated defective nozzles $\mathbf{25}_{NGX}$ constituting the non-guaranteed pattern CP in a forced ejection nozzle candidate list (simply abbreviated to a candidate list below) 60. Subsequently, the selection unit 56 excludes the nozzle numbers of the concentrated defective nozzles $\mathbf{25}_{NGX}$ from the candidate list 60 according to a forced ejection nozzle selection rule (a forced recording element selection rule) described below based on the defective nozzle information (see FIG. 4) in the defective nozzle information table 50, and eventually selects the Q forced ejection nozzles 25A. In the forced ejection nozzle selection rule (simply abbreviated to a selection rule below), the types, the detection timings, the temporal stabilities, and the ejection deflection amounts of the concentrated defective nozzles $\mathbf{25}_{NGX}$ are determined in advance as selection conditions. The selection rule mainly includes first to fourth selection rules corresponding to the respective selection conditions.

Figure 12:
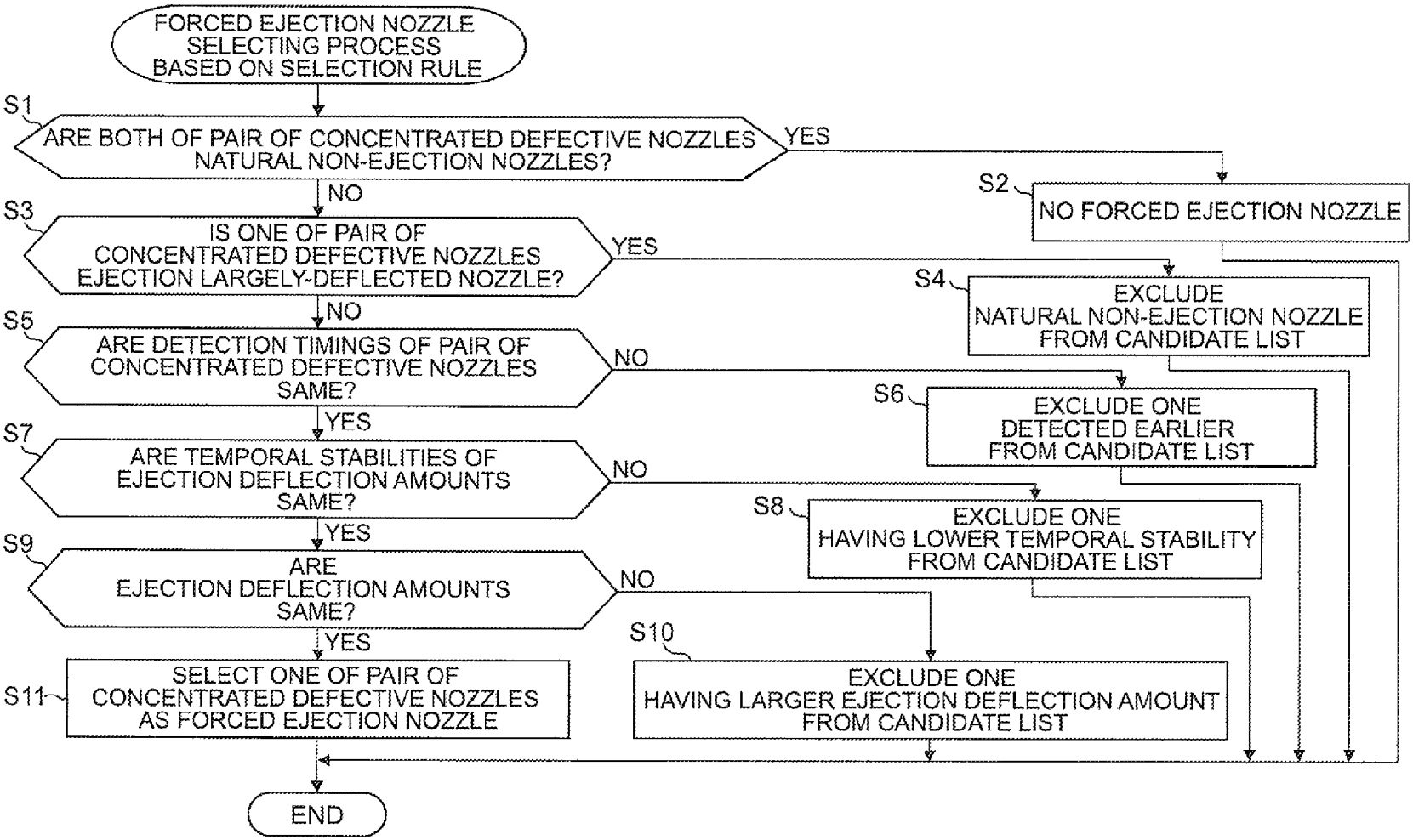
FIG. 12 is a flowchart illustrating a flow of a process of selecting a forced ejection nozzle.

Next, a forced ejection nozzle selecting process by the selection unit 56 is specifically described by using a flowchart in FIG. 12. Here, a case in which the non-guaranteed pattern CP is composed of two concentrated defective nozzles $\mathbf{25}_{NGX}$ (referred to as a pair of concentrated defective nozzles $\mathbf{25}_{NGX}$ below), and one forced ejection nozzle 25A is selected therefrom is described. In this case, the pair of concentrated defective nozzles $\mathbf{25}_{NGX}$ correspond to a first concentrated defective recording element and a second concentrated defective recording element in the presently disclosed subject matter.

First, the selection unit 56 reads out the defective nozzle information corresponding to the pair of concentrated defective nozzles $\mathbf{25}_{NGX}$ from the defective nozzle information table 50 based on the nozzle numbers registered in the candidate list 60.

Subsequently, the selection unit 56 performs selection according to a first selection rule that an ejection largely-deflected nozzle is preferentially selected as the forced ejection nozzle 25A based on the "defective nozzle types" of the pair of concentrated defective nozzles $\mathbf{25}_{NGX}$ in the defective nozzle information. In this case, the selection unit 56 determines whether or not both of the pair of concentrated defective nozzles $\mathbf{25}_{NGX}$ are natural non-ejection nozzles (step S1). Since the ink 52 cannot be ejected from the natural non-ejection nozzle, the selection unit 56 excludes the nozzle numbers of the pair of concentrated defective nozzles $\mathbf{25}_{NGX}$ from the candidate list 60 and does not select the forced ejection nozzle 25A when determining YES in step S1 (step S2).

Meanwhile, when determining that at least one of the pair of concentrated defective nozzles $\mathbf{25}_{NGX}$ is an ejection largely-deflected nozzle (NO in step S1), the selection unit 56 determines whether or not only one of the pair of concentrated defective nozzles $\mathbf{25}_{NGX}$ is an ejection largely-deflected nozzle (step S3). Although the ink 52 cannot be ejected from the natural non-ejection nozzle, the ink 52 can be ejected from the ejection largely-deflected nozzle. Therefore, when determining YES in step S3, the selection unit 56 excludes the nozzle number of the natural non-ejection nozzle from the candidate list 60 (step S4). Accordingly, the ejection largely-deflected nozzle is selected as the forced ejection nozzle 25A.

The selection unit 56 performs selection according to a second selection rule that the one detected later (late) is preferentially selected as the forced ejection nozzle 25A when determining that both of the pair of concentrated defective nozzles $\mathbf{25}_{NGX}$ are ejection largely-deflected nozzles (NO in step S3). In this case, the selection unit 56 determines whether or not the detection timings of the two nozzles are the same based on the "detection date and time" of the two nozzles in the defective nozzle information (step S5). Various image quality correction processing (density unevenness correction processing or the like) are likely to be already applied to the concentrated defective nozzle $\mathbf{25}_{NGX}$ detected earlier. Therefore, when determining NO in step S5, the selection unit 56 excludes the one detected earlier out of the pair of concentrated defective nozzles $\mathbf{25}_{NGX}$ from the candidate list 60 (step S6). Accordingly, the one detected later out of the pair of concentrated defective nozzles $\mathbf{25}_{NGX}$ is preferentially selected as the forced ejection nozzle 25A.

Meanwhile, when the detection timings of both of the pair of concentrated defective nozzles $\mathbf{25}_{NGX}$ (the ejection largely-deflected nozzles) are the same (YES in step S5), the selection unit 56 performs selection according to a third selection rule that the one, the ejection deflection amount (the magnitude of ejection deflection) of which has a higher temporal stability, is preferentially selected as the forced ejection nozzle 25A. In this case, the selection unit 56 obtains the temporal stabilities of the ejection deflection amounts of the two nozzles based on the "nozzle numbers" and the "ejection deflection amounts" of the two nozzles. The temporal stability is represented by, for example, dispersion of the ejection deflection amount that changes over time, a difference between a maximum value and a minimum value of the ejection deflection amount or the like.

Subsequently, the selection unit 56 determines whether or not the temporal stabilities of the ejection deflection amounts of the pair of concentrated defective nozzles $\mathbf{25}_{NGX}$ are the same (including almost the same) (step S7). By ejecting the ink 52 from the one, the ejection deflection amount of which has a higher temporal stability, out of the pair of concentrated defective nozzles $\mathbf{25}_{NGX}$ and thereby performing image recording, the temporal stability of the image quality of the recorded image is improved, and various image quality correction processing (density unevenness correction processing or the like) can also be stably applied. Therefore, when determining NO in step S7, the selection unit 56 excludes the one, the ejection deflection amount of which has a lower temporal stability, out of the pair of concentrated defective nozzles $\mathbf{25}_{NGX}$ from the candidate list 60 (step S8). Accordingly, the one, the ejection deflection amount of which has a higher temporal stability, out of the pair of concentrated defective nozzles $\mathbf{25}_{NGX}$ is preferentially selected as the forced ejection nozzle 25A.

Meanwhile, when determining that the temporal stabilities of both of the pair of concentrated defective nozzles $\mathbf{25}_{NGX}$ are the same (YES in step S7), the selection unit 56 performs selection according to a fourth selection rule that the one having a smaller ejection deflection amount is preferentially selected as the forced ejection nozzle 25A. In this case, the selection unit 56 determines whether or not the ejection deflection amounts of the two nozzles are the same (including almost the same) based on the "ejection deflection amounts" of the two nozzles in the defective nozzle information (step S9). By ejecting the ink 52 from the one having a smaller ejection deflection amount out of the pair of concentrated defective nozzles $25_{NGX}$, interference with a nozzle 25 in the vicinity thereof is decreased, and correction close to design is achieved. Therefore, when determining NO in step S9, the selection unit 56 excludes the one having a larger ejection deflection amount out of the pair of concentrated defective nozzles $25_{NGX}$ from the candidate list 60 (step S10). Accordingly, the one having a smaller ejection deflection amount out of the pair of concentrated defective nozzles $25_{NGX}$ is preferentially selected as the forced ejection nozzle 25A.

When determining that the ejection deflection amounts of both of the pair of concentrated defective nozzles $25_{NGX}$ (the ejection largely-deflected nozzles) are the same (YES in step S9), the selection unit 56 selects one of the two nozzles as the forced ejection nozzle 25A, and excludes the other from the candidate list 60 (step S11).

The process of selecting the forced ejection nozzle 25A by the selection unit 56 is thereby completed. The selection unit 56 outputs the candidate list 60 indicating the result of the process of selecting the forced ejection nozzle 25A to the non-ejection correction processing unit 57. When the determination unit 55 determines that a plurality of non-guaranteed patterns CP are generated, the selection unit 56 performs the aforementioned forced ejection nozzle selecting process for each of the non-guaranteed patterns CP, and outputs the candidate lists 60 indicating the results to the non-ejection correction processing unit 57.

When the determination unit 55 determines that the non-guaranteed pattern CP is not generated or it is determined as YES in step S1, the selection unit 56 outputs information indicating such determination (or may output an empty candidate list 60) to the non-ejection correction processing unit 57.

(Non-Ejection Correction Processing)

Returning back to FIG. 5, the non-ejection correction processing unit 57 performs the non-ejection correction processing (output correction) on the image signal subjected to the tone conversion processing in the tone conversion processing unit 22 based on the non-ejection correction LUT 45 and the defective nozzle information table 50 in the data storage unit 28, and the candidate list 60 input from the selection unit 56. At this point, a suspension processing control unit (a control unit) 57*a* of the non-ejection correction processing unit 57 excludes the forced ejection nozzle 25A from an object of output suspension processing when the forced ejection nozzle 25A is selected (registered in the candidate list 60) by the selection unit 56.

To be more specific, the suspension processing control unit 57*a* compares the defective nozzle information table 50 and the candidate list 60, and identifies the position (the nozzle number or the like) of the defective nozzle $25_{NG}$ other than the forced ejection nozzle 25A. The suspension processing control unit 57*a* controls the non-ejection correction processing unit 57 to perform the output suspension processing as illustrated in FIG. 6 on the defective nozzle $25_{NG}$ other than the forced ejection nozzle 25A. The non-ejection correction processing unit 57 also performs the signal conversion processing on the image signals corresponding to the adjacent nozzles 25 so as to increase the ink ejection amounts of the adjacent nozzles 25 adjacent to all the defective nozzles $25_{NG}$ including the forced ejection nozzle 25A based on the non-ejection correction LUT 45.

Here, the adjacent nozzle 25 is not limited to a nozzle adjacent to the defective nozzle $25_{NG}$, and also includes a nozzle 25 for recording a pixel adjacent to a pixel corresponding to the defective nozzle $25_{NG}$, that is, a nozzle that is not necessarily adjacent to the defective nozzle $25_{NG}$. The defective nozzle $25_{NG}$ subjected to the output suspension processing in the non-ejection correction processing unit 57 is not limited to the latest defective nozzles $25_{NG}$ detected in the defective nozzle detecting process, but may also include one of the defective nozzles $25_{NG}$ detected in the past.

<Operation of the Printing System>

Figure 13:
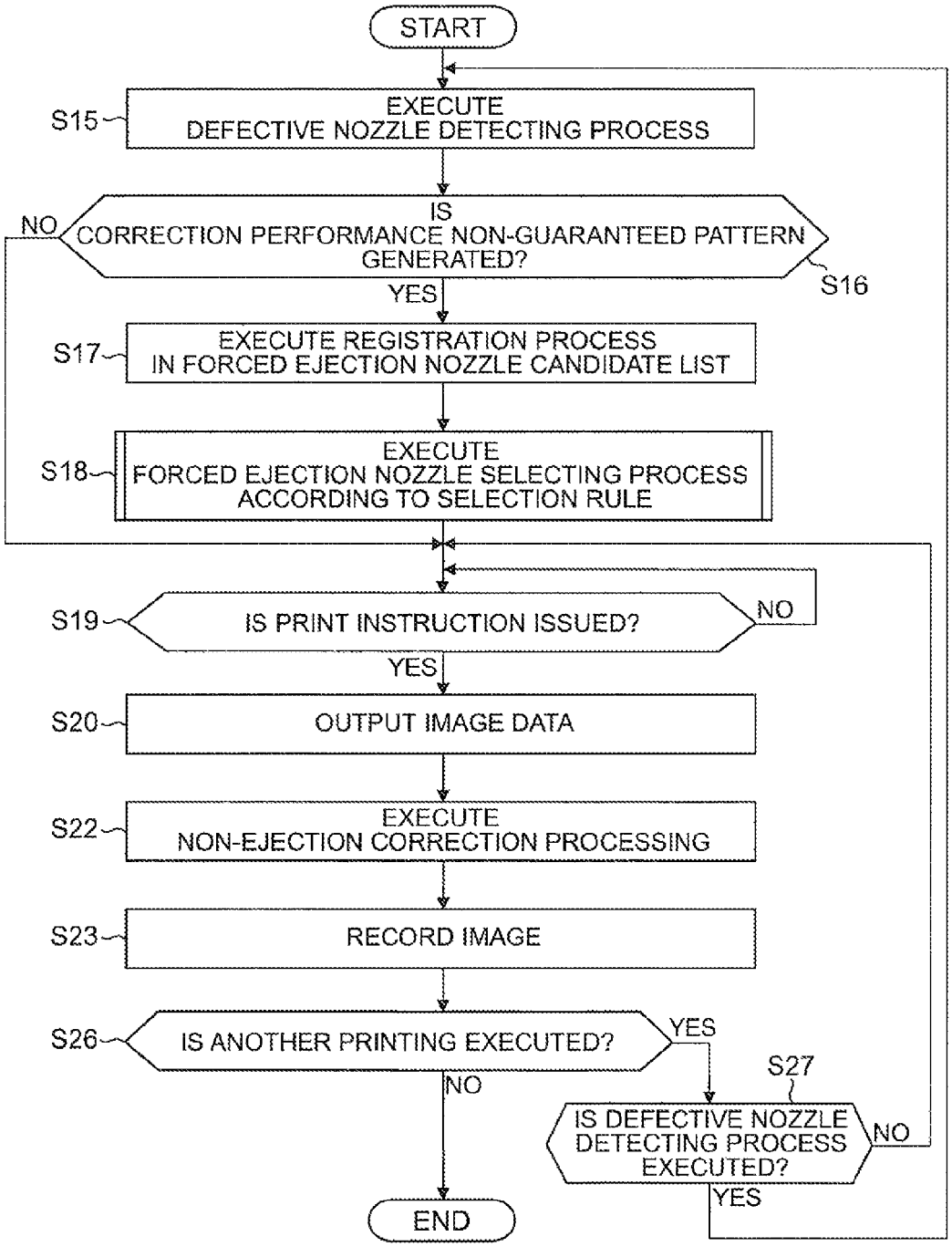
FIG. 13 is a flowchart illustrating a flow of an image recording process of the ink-jet printing system.

Next, the printing process of the printing system 10 having the aforementioned configuration is described by using a flowchart illustrated in FIG. 13. For example, when the printing system 10 is started or the ink-jet head 11 is replaced, the respective units of the printer 13 and the PC 14 are operated under the command of the printing process control unit 30 to start the defective nozzle detecting process (step S15, a defective recording element detection step).

The printing process control unit 30 outputs the data of the defective nozzle detecting test chart 49 to the printer 13, and issues a test chart record command to the printer 13. Upon receiving the command, the marking unit 20 of the printer 13 records the line patterns 49*a* on the recording medium 12 by the respective nozzles 25 of the ink-jet head 11 based on the data (or simply a pattern record command) input from the printing process control unit 30. Accordingly, the defective nozzle detecting test chart 49 is recorded on the recording medium 12.

The printing process control unit 30 causes the in-line sensor 21 to start reading the defective nozzle detecting test chart 49 at a timing at which the defective nozzle detecting test chart 49 passes through the in-line sensor 21 along with conveyance of the recording medium 12. Accordingly, the defective nozzle detecting test chart 49 is read by the in-line sensor 21, and the reading result is output to the defective nozzle detection unit 40.

The defective nozzle detection unit 40 detects the defective nozzle $25_{NG}$ by analyzing the reading result of the defective nozzle detecting test chart 49, and generates the defective nozzle information (the detection date and time, the nozzle number, the defective nozzle type, and the ejection deflection amount) indicating the detection result. Subsequently, the defective nozzle detection unit 40 stores the defective nozzle information corresponding to the respective defective nozzles $25_{NG}$ in the defective nozzle information table 50 within the data storage unit 28.

After completion of the defective nozzle detecting process, the determination unit 55 determines whether or not each of all the defective nozzles $25_{NG}$ satisfies the condition 2 with any another defective nozzle $25_{NG}$ as illustrated in FIGS. 9 to 11 based on the defective nozzle information in the defective nozzle information table 50 within the data storage unit 28 (step S16, a determination step). The determination unit 55 determines whether or not the non-guaranteed pattern CP is generated based on whether the condition 2 is satisfied at least one position, and outputs the determination result to the selection unit 56. The determination unit 55 also reads out the nozzle numbers of the concentrated defective nozzles $25_{NGX}$ included in the non-guaranteed pattern CP from the defective nozzle information table 50 when the pattern is generated, and outputs the nozzle numbers to the selection unit 56. Here, a case in which the non-guaranteed pattern CP is composed of a pair of concentrated defective nozzles $25_{NGX}$ is described.

When the determination result indicating that the non-guaranteed pattern CP is generated is input from the determination unit 55 (YES in step S16), the selection unit 56 registers the nozzle numbers of the concentrated defective nozzles $25_{NGX}$ input from the determination unit 55 in the candidate list 60 (step S17). Subsequently, the selection unit 56 executes the process from step S1 to step S11 described above illustrated in FIG. 12 based on the defective nozzle information in the defective nozzle information table 50 to thereby select one forced ejection nozzle 25A (step S18, a selection step). The selection unit 56 outputs the candidate list 60 indicating the selection result of the forced ejection nozzle 25A to the non-ejection correction processing unit 57. When the determination unit 55 determines that a plurality of non-guaranteed patterns CP are generated, the selection unit 56 performs the forced ejection nozzle selecting process for each of the non-guaranteed patterns CP, and outputs the candidate lists 60 indicating the selection results to the non-ejection correction processing unit 57.

When the determination unit 55 determines that the non-guaranteed pattern CP is not generated (NO in step S16) or when both of the pair of concentrated defective nozzles $\mathbf{25}_{NGX}$ are natural non-ejection nozzles, the selection unit 56 outputs the information indicating such determination to the non-ejection correction processing unit 57.

The process of selecting the forced ejection nozzle 25A by the selection unit 56 is thereby completed. The process from step S15 to step S18 may be performed a plurality of times before subsequent step S19 is started.

When a print instruction is issued from the input device 17 (step S19), the printing process control unit 30 outputs the image data 18 to the printer 13, and issues an image record command to the printer 13 (step S20).

The tone conversion processing unit 22 performs the tone conversion processing on the image data 18 upon receiving the command from the printing process control unit 30. The non-ejection correction processing unit 57 performs the non-ejection correction processing on the image signal subjected to the tone conversion processing in the tone conversion processing unit 22 based on the non-ejection correction LUT 45 and the defective nozzle information table 50 in the data storage unit 28, and the candidate list 60 input from the selection unit 56 (step S22, an output correction step).

First, the suspension processing control unit 57*a* of the non-ejection correction processing unit 57 compares the defective nozzle information table 50 and the candidate list 60, and identifies the position (the nozzle number or the like) of the defective nozzle $\mathbf{25}_{NG}$ other than the forced ejection nozzle 25A. The suspension processing control unit 57*a* controls the non-ejection correction processing unit 57 to perform the output suspension processing on the defective nozzle $\mathbf{25}_{NG}$ other than the forced ejection nozzle 25A (see FIG. 14). The non-ejection correction processing unit 57 also performs the signal conversion processing on the image signals corresponding to the adjacent nozzles 25 so as to increase the ink ejection amounts of the adjacent nozzles 25 adjacent to all the defective nozzles $\mathbf{25}_{NG}$ based on the non-ejection correction LUT 45. When there is no forced ejection nozzle 25A, the suspension processing control unit 57*a* controls the non-ejection correction processing unit 57 to perform the output suspension processing on all the defective nozzles $\mathbf{25}_{NG}$.

The image signal of the image data 18 subjected to the non-ejection correction processing is subjected to the halftone processing in the halftone processing unit 24 to be converted to the marking signal, which is then output to the marking unit 20. Accordingly, the image based on the image data 18 is recorded on the recording medium 12 in the marking unit 20 (step S23).

When printing is performed again based on another image data 18 (YES in step S26), the process from step S20 to S23 described above is repeated.

At this point, when a predetermined time has elapsed after the previous defective nozzle detecting process, when printing of a predetermined number of sheets is performed, or when an instruction to execute the defective nozzle detecting process from a user is received, the defective nozzle detecting process is started again (YES in step S27). Accordingly, the process from step S15 to step S18 described above is repeated, and the selection unit 56 selects a new forced ejection nozzle 25A.

Subsequently, the process of the respective steps described above is repeated until the printing in the printing system 10 is completed.

<Operation Effect of the Printing System>

Figure 14:
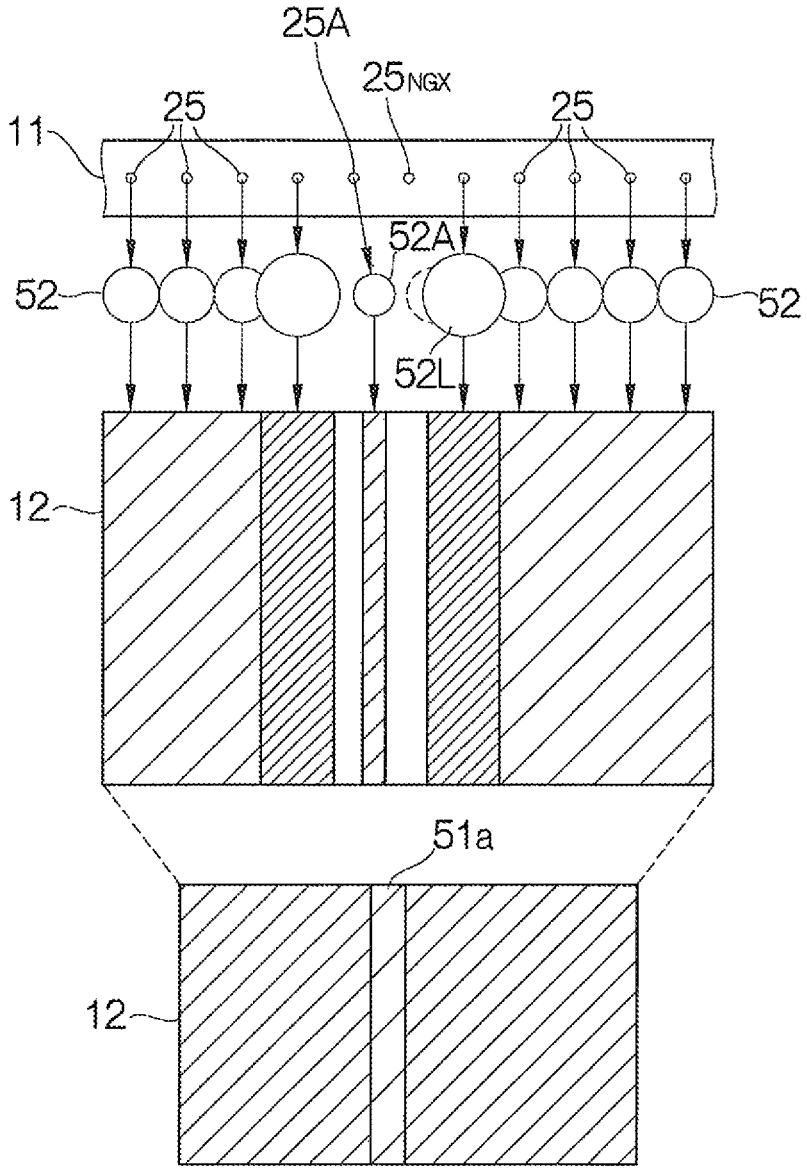
FIG. 14 is an explanatory view for explaining the effect of image recording using the forced ejection nozzle in the non-ejection correction processing.

By selecting one of the pair of concentrated defective nozzles $\mathbf{25}_{NGX}$ as the forced ejection nozzle 25A and ejecting the ink 52A from the forced ejection nozzle 25A as illustrated in FIG. 14, the lack of the ink amount or the ink dot size can be compensated to some extent. Therefore, when one of the pair of concentrated defective nozzles $\mathbf{25}_{NGX}$ is selected as the forced ejection nozzle 25A, the correction ability of the white-stripe unevenness 51*a* is improved as compared to the case in which both of the pair of concentrated defective nozzles $\mathbf{25}_{NGX}$ are made to eject no ink as illustrated in FIG. 8. Accordingly, the white-stripe unevenness 51*a* becomes less noticeable for a user as compared to the case in which both of the pair of concentrated defective nozzles $\mathbf{25}_{NGX}$ are made to eject no ink. As described above, by appropriately selecting the nozzle which is made to eject no ink out of the defective nozzles $\mathbf{25}_{NG}$ detected in the defective nozzle detecting process in view of the performance of the non-ejection correction technique, the image quality of the recorded image can be improved.

<Another Embodiment of the Forced Ejection Nozzle Selecting Process>

Figure 15:
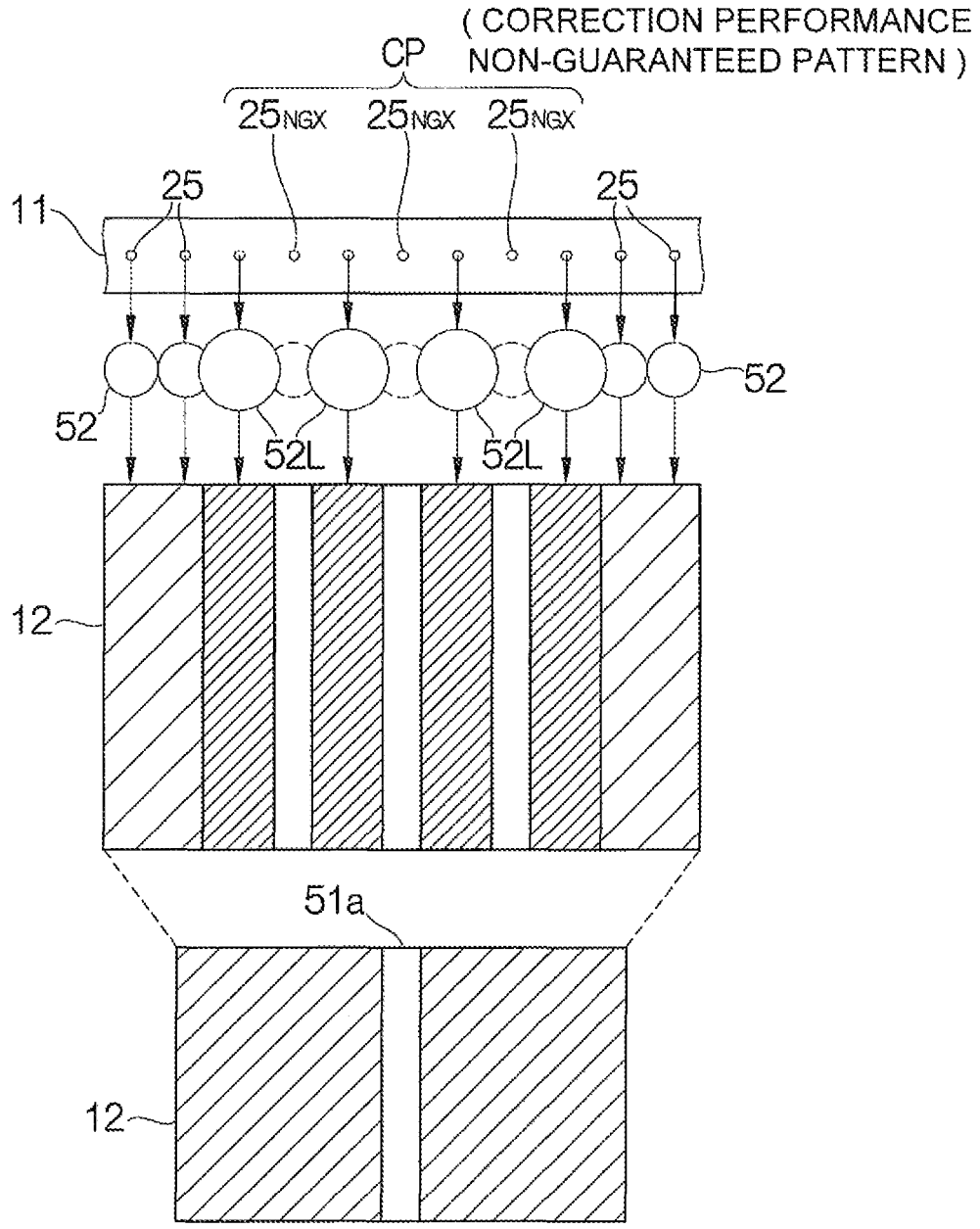
FIG. 15 is an explanatory view for explaining the occurrence of stripe unevenness when three ejection largely-deflected nozzles are generated close to each other.

While the selection unit 56 according to the aforementioned embodiment selects one of the two concentrated defective nozzles $\mathbf{25}_{NGX}$ (the pair of concentrated defective nozzles $\mathbf{25}_{NGX}$) constituting the non-guaranteed pattern CP as the forced ejection nozzle 25A, the non-guaranteed pattern CP may be composed of three or more concentrated defective nozzles $\mathbf{25}_{NGX}$ as illustrated in FIG. 15. In this case, when all of the concentrated defective nozzles $\mathbf{25}_{NGX}$ are made to eject no ink in the non-ejection correction processing, the correction ability of the white-stripe unevenness 51*a* is decreased due to the lack of the ink amount or the like only by increasing the output densities of adjacent nozzles 25. Thus, the white-stripe unevenness 51*a* is clearly visually recognized by a user. Therefore, when the non-guaranteed pattern CP is composed of three or more concentrated defective nozzles $\mathbf{25}_{NGX}$, the selection unit 56 selects at least one forced ejection nozzle 25A therefrom.

In the following, the forced ejection nozzle selecting process when the non-guaranteed pattern CP is composed of three or more concentrated defective nozzles $\mathbf{25}_{NGX}$ is described. Since the process up to the registration of the nozzles numbers of all the concentrated defective nozzles $\mathbf{25}_{NGX}$ constituting the non-guaranteed pattern CP in the candidate list 60 is the same as that of the aforementioned embodiment, the description is omitted here. In this case, any two concentrated defective nozzles $\mathbf{25}_{NGX}$ out of the three or more concentrated defective nozzles $\mathbf{25}_{NGX}$ correspond to the first concentrated defective recording element and the second concentrated defective recording element in the presently disclosed subject matter.

Figure 16:
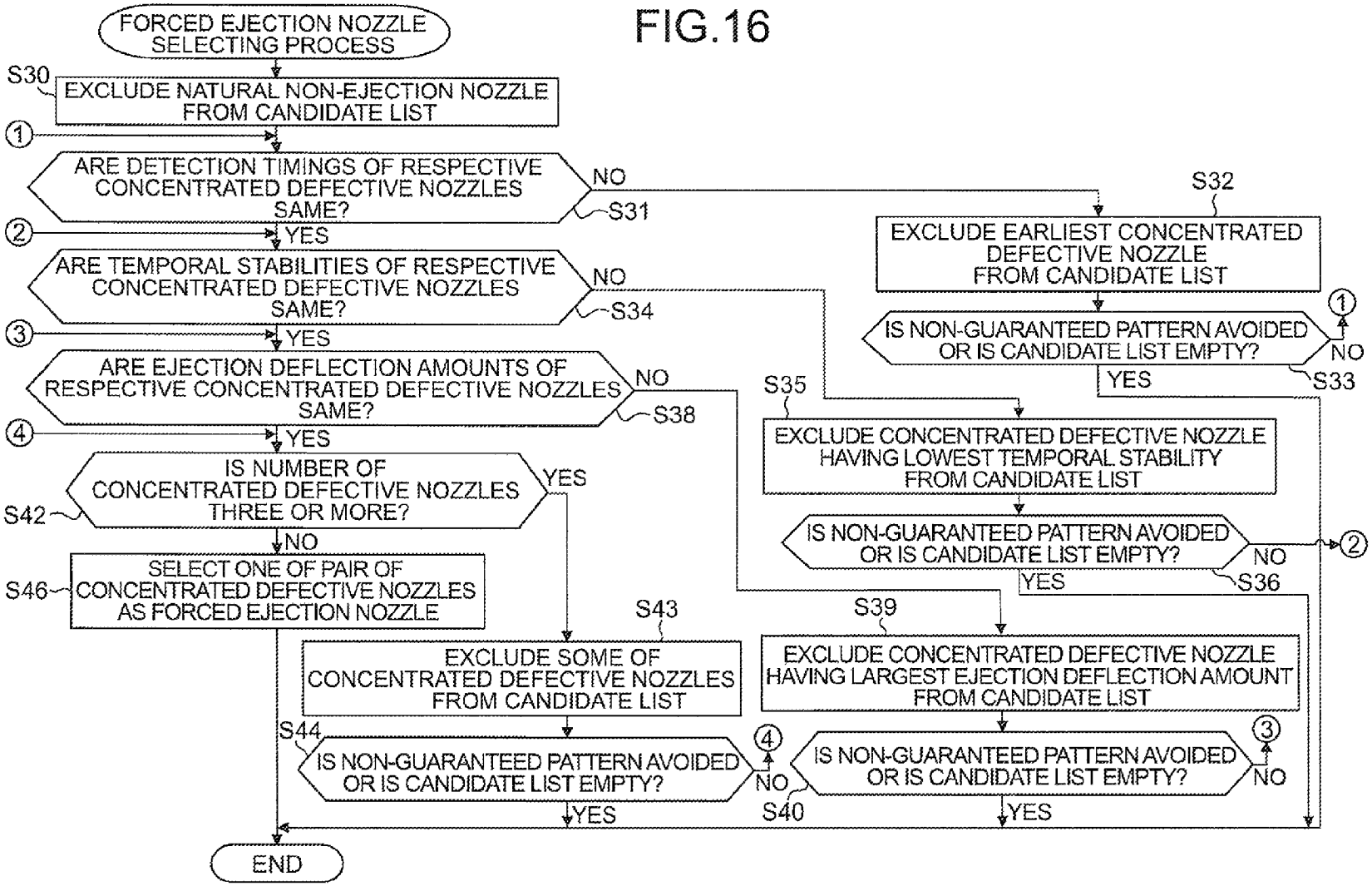
FIG. 16 is a flowchart illustrating a flow of a process of selecting a forced ejection nozzle when the correction performance non-guaranteed pattern is composed of three or more concentrated defective nozzles.

As illustrated in FIG. 16, the selection unit 56 performs a selecting process according to the above first selection rule. To be more specific, the selection unit 56 deletes the nozzle number corresponding to the natural non-ejection nozzle which cannot eject the ink 52 from the candidate list 60 based on the "defective nozzle types" of the respective concentrated defective nozzles $25_{NGX}$ in the defective nozzle information (step S30). That is, the ejection largely-deflected nozzle is selected as a candidate of the forced ejection nozzle 25A in the selection unit 56. Although not illustrated in the drawings, when all of the concentrated defective nozzles $25_{NGX}$ are natural non-ejection nozzles, the forced ejection nozzle 25A is not selected in the selection unit 56 since the candidate list 60 is empty.

Subsequently, the selection unit 56 performs a selecting process according to the above second selection rule. To be more specific, the selection unit 56 determines whether or not all of the detection timings of the remaining concentrated defective nozzles $25_{NGX}$ (the ejection largely-deflected nozzles) are the same based on the "detection date and time" of the remaining concentrated defective nozzles $25_{NGX}$ in the defective nozzle information (step S31).

When determining NO in step S31, the selection unit 56 deletes the nozzle number corresponding to the earliest concentrated defective nozzle $25_{NGX}$ from the candidate list 60 (step S32). Various image quality correction processing are most likely to be already applied to the concentrated defective nozzle $25_{NGX}$. After deletion of the nozzle number, the selection unit 56 determines whether or not the remaining concentrated defective nozzles $25_{NGX}$ no longer constitute the non-guaranteed pattern CP (that is, whether or not the non-guaranteed pattern CP is avoided), or whether or not the candidate list 60 is empty (step S33). When determining YES in step S33, the selection unit 56 does not select the forced ejection nozzle 25A since there is no concentrated defective nozzle $25_{NGX}$ that can be selected as the forced ejection nozzle 25A.

When determining NO in step S33, the selection unit 56 determines again whether or not all of the detection timings of the remaining concentrated defective nozzles $25_{NGX}$ are the same (step S31). The selection unit 56 repeats the processes of step S32 and step S33 described above when determining NO again in the determination in step S31. Subsequently, the selection unit 56 repeats the process from step S31 to step S33 until determining YES in step S31 or step S33.

Meanwhile, when determining that all of the detection timings of the remaining concentrated defective nozzles $25_{NGX}$ are the same (YES in step S31), the selection unit 56 performs a selecting process according to the above third selection rule. To be more specific, the selection unit 56 obtains the temporal stabilities of the respective ejection deflection amounts based on the "nozzle numbers" and the "ejection deflection amounts" of the respective concentrated defective nozzles $25_{NGX}$ in the nozzle information. The selection unit 56 determines whether or not the temporal stabilities of the ejection deflection amounts of the remaining concentrated defective nozzles $25_{NGX}$ (the ejection largely-deflected nozzles) are the same (step S34).

When determining NO in step S34, the selection unit 56 deletes the nozzle number corresponding to the concentrated defective nozzle $25_{NGX}$ having a lowest temporal stability out of the remaining concentrated defective nozzles $25_{NGX}$ from the candidate list 60 (step S35). Regarding the concentrated defective nozzle $25_{NGX}$, the image quality of the recorded image has a lowest temporal stability, and various image quality correction processing is most unstably applied out of the remaining concentrated defective nozzles $25_{NGX}$. After deleting the nozzle number, the selection unit 56 determines whether or not the non-guaranteed pattern CP is avoided, or whether or not the candidate list 60 is empty (step S36) similarly to step S33 described above. When determining YES in step S36, the selection unit 56 does not select the forced ejection nozzle 25A since there is no concentrated defective nozzle $25_{NGX}$ that can be selected as the forced ejection nozzle 25A.

When determining NO in step S36, the selection unit 56 determines again whether or not all of the temporal stabilities of the ejection deflection amounts of the remaining concentrated defective nozzles $25_{NGX}$ are the same (step S34). The selection unit 56 repeats the processes of step S35 and step S36 described above when determining NO again in the determination in step S34. Subsequently, the selection unit 56 repeats the process from step S34 to step S36 until determining YES in step S34 or step S36.

Meanwhile, when determining that all of the temporal stabilities of the ejection deflection amounts of the remaining concentrated defective nozzles $25_{NGX}$ are the same (YES in step S34), the selection unit 56 performs a selecting process according to the above fourth selection rule. To be more specific, the selection unit 56 determines whether or not the respective ejection deflection amounts are the same based on the "ejection deflection amounts" of the respective concentrated defective nozzles $25_{NGX}$ in the nozzle information (step S38).

When determining NO in step S38, the selection unit 56 deletes the nozzle number corresponding to the concentrated defective nozzle $25_{NGX}$ having a largest ejection deflection amount out of the remaining concentrated defective nozzles $25_{NGX}$ from the candidate list 60 (step S39). In the concentrated defective nozzle $25_{NGX}$, interference with a nozzle 25 in the vicinity thereof becomes largest when the ink 52 is ejected out of the remaining concentrated defective nozzles $25_{NGX}$. After deletion of the nozzle number, the selection unit 56 determines whether or not the non-guaranteed pattern CP is avoided, or whether or not the candidate list 60 is empty (step S40) similarly to step S33 and step S36 described above. When determining YES in step S40, the selection unit 56 does not select the forced ejection nozzle 25A since there is no concentrated defective nozzle $25_{NGX}$ that can be selected as the forced ejection nozzle 25A.

When determining NO in step S40, the selection unit 56 determines again whether or not all of the ejection deflection amounts of the remaining concentrated defective nozzles $25_{NGX}$ are the same (step S38). The selection unit 56 repeats the processes of step S39 and step S40 described above when determining NO again in the determination in step S38. Subsequently, the selection unit 56 repeats the process from step S38 to step S40 until determining YES in step S38 or step S40.

Meanwhile, when determining that all of the ejection deflection amounts of the remaining concentrated defective nozzles $25_{NGX}$ are the same (YES in step S38), the selection unit 56 determines whether or not the number of the remaining concentrated defective nozzles $25_{NGX}$ constituting the non-guaranteed pattern CP is three or more (step S42).

Subsequently, when determining YES in step S42, the selection unit 56 selects the forced ejection nozzle 25A according to a fifth selection rule described below. To be more specific, the selection unit 56 performs thinning out to exclude the nozzle numbers corresponding to some of the three or more concentrated defective nozzles $25_{NGX}$ constituting the non-guaranteed pattern CP from the candidate list 60 (step S43). At this point, the non-guaranteed pattern CP is preferably avoided by performing thinning-out processing so as to decrease the number of forced ejection nozzles 25A as the defective nozzles $25_{NG}$ to minimum possible. For example, when the non-guaranteed pattern CP is composed of the three concentrated defective nozzles $25_{NGX}$ as illustrated in FIG. 15, one forced ejection nozzle 25A in the center remains by thinning out two nozzles on both sides. This is, when 2α+1 (α is a natural number of at least 1) concentrated defective nozzles $25_{NGX}$ are arranged in an arrangement direction of the nozzles 25, a 2β-th (β is a natural number of 1 or more and α or less) concentrated defective nozzle $25_{NGX}$ is set as the forced ejection nozzle 25A. The number of forced ejection nozzles 25A can be thereby decreased.

After the thinning-out processing, the selection unit 56 determines whether or not the non-guaranteed pattern CP is avoided, or whether or not the candidate list 60 is empty (step S44). When determining YES in step S44, the selection unit 56 does not select the forced ejection nozzle 25A since there is no concentrated defective nozzle $25_{NGX}$ that can be selected as the forced ejection nozzle 25A.

When determining NO in step S44, the selection unit 56 determines again whether or not the number of the remaining concentrated defective nozzles $25_{NGX}$ is three or more (step S42). The selection unit 56 repeats the processes of step S43 and step S44 described above when determining NO again in the determination in step S42. Subsequently, the selection unit 56 repeats the process from step S42 to step S44 until determining YES in step S42 or step S44.

Meanwhile, when determining NO in step S42, that is, when the non-guaranteed pattern CP is composed of two concentrated defective nozzles $25_{NGX}$ (a pair of concentrated defective nozzles $25_{NGX}$), the selection unit 56 selects one of the two nozzles as the forced ejection nozzle 25A, and excludes the other from the candidate list 60 (step S46). The process of selecting the forced ejection nozzle 25A by the selection unit 56 is thereby completed. Since the subsequent processes are the same as those of the aforementioned embodiment, the description is omitted.

Figure 17:
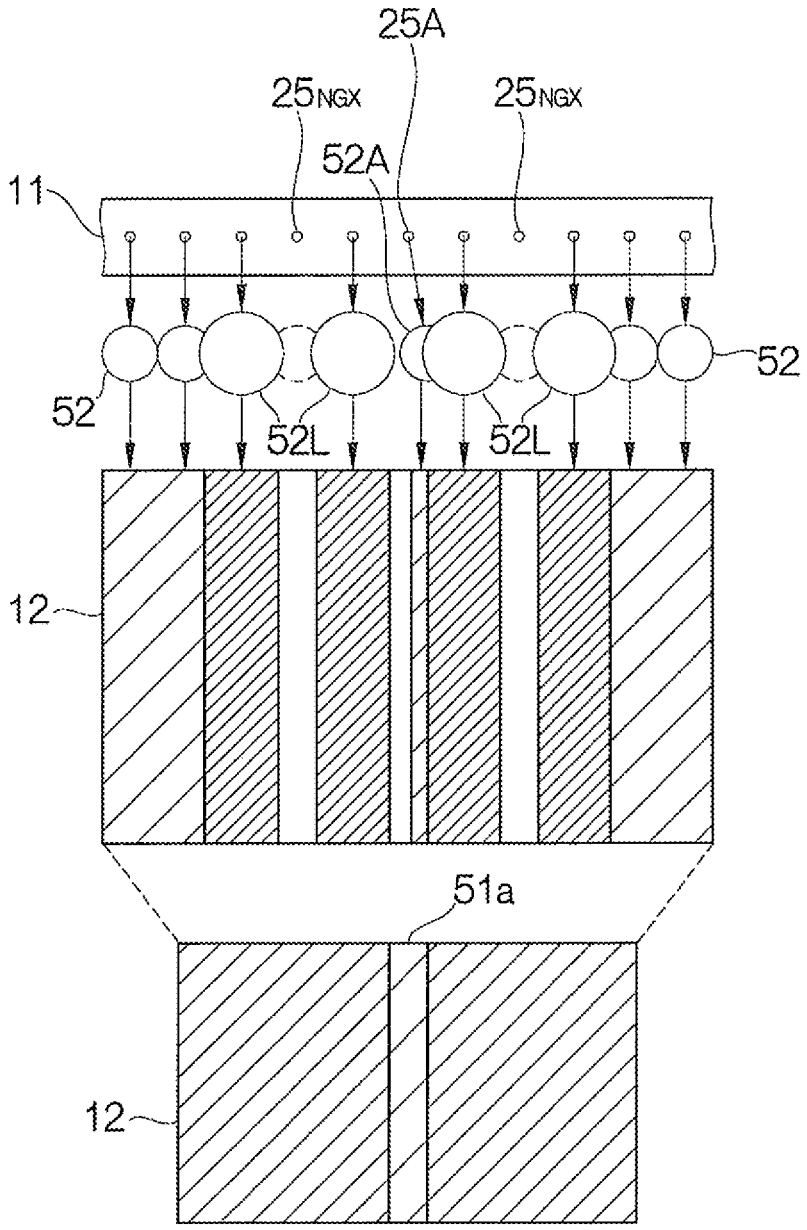
FIG. 17 is an explanatory view for explaining the effect of image recording using the forced ejection nozzle in the non-ejection correction processing.

By ejecting the ink 52A from at least one forced ejection nozzle 25A out of the three concentrated defective nozzles $25_{NGX}$ constituting the non-guaranteed pattern CP as illustrated in FIG. 17, the lack of the ink amount or the ink dot size can be compensated to some extent. Therefore, the correction ability of the white-stripe unevenness 51*a* is improved similarly to the aforementioned embodiment. Accordingly, the white-stripe unevenness 51*a* becomes less noticeable for a user as compared to a case in which all of the concentrated defective nozzles $25_{NGX}$ are made to eject no ink. The image quality of the recorded image can be thereby improved.

Although the process of selecting at least one forced ejection nozzle 25A out of the three concentrated defective nozzles $25_{NGX}$ constituting the non-guaranteed pattern CP is described as an example in FIGS. 15 to 17, the method illustrated in FIG. 16 may also be applied when the Q ($1 \leq Q < P$) forced ejection nozzles 25A are selected out of the P concentrated defective nozzles $25_{NGX}$.

[Ink-Jet Printing System According to a Second Embodiment]

Figure 18:
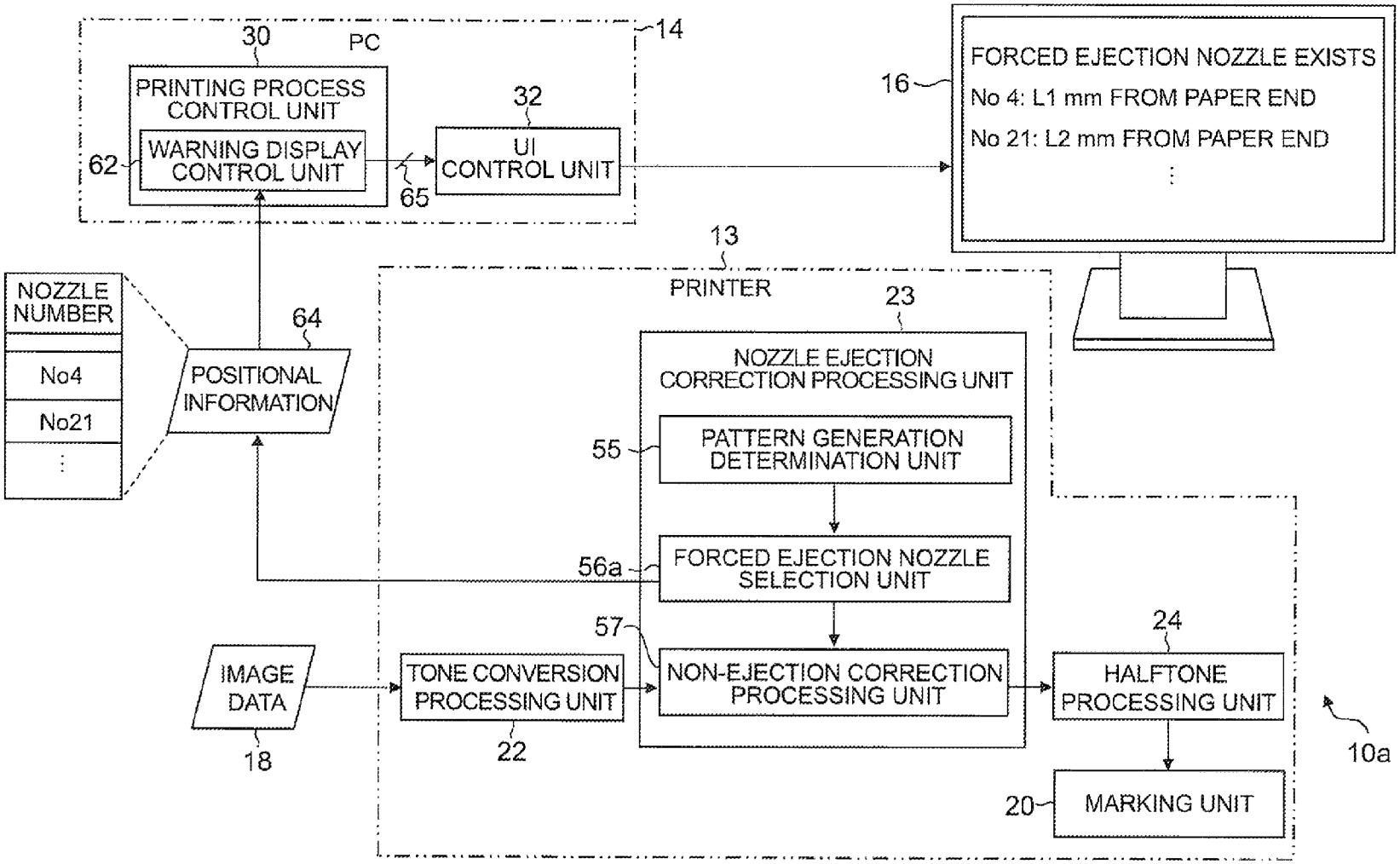
FIG. 18 is a schematic diagram of an ink-jet printing system according to a second embodiment which displays a warning when image recording is performed using the forced ejection nozzle.

Next, a printing system 10*a* according to a second embodiment of the presently disclosed subject matter is described by using FIG. 18. In the first embodiment, when the image recording is performed by ejecting the ink 52 from the forced ejection nozzle 25A in the non-ejection correction processing, a warning indicating that the ink 52 is ejected from the forced ejection nozzle 25A is not displayed. However, since the image recording is performed by using the forced ejection nozzle 25A, the recorded image may not always have a best image quality. Thus, when the image recording is performed by using the forced ejection nozzle 25A, the printing system 10*a* displays a warning to warn that the image recording is performed by using the forced ejection nozzle 25A.

The printing system 10*a* basically has the same configuration as the printing system 10 according to the first embodiment except that the nozzle ejection correction processing unit 23 functions as a forced ejection nozzle selection unit (a selection unit) 56*a* different from that of the first embodiment, and the printing process control unit 30 functions as a warning display control unit 62. Therefore, components having the same functions and configurations as those of the first embodiment are assigned the same reference numerals, and the description is omitted. In the following, the forced ejection nozzle selection unit 56*a* is simply referred to as a "selection unit 56*a*."

The selection unit 56*a* is basically the same as the selection unit 56 in the first embodiment. However, the selection unit 56*a* outputs positional information 64 indicating the position of the forced ejection nozzle 25A to the warning display control unit 62 after the process of selecting the forced ejection nozzle 25A. The position of the forced ejection nozzle 25A here means the position of the forced ejection nozzle 25A in the ink-jet head 11 (the nozzle number or the like), or the recording position of the forced ejection nozzle 25A on the recording medium 12. Therefore, the positional information 64 includes, for example, the nozzle number of the forced ejection nozzle 25A similarly to the candidate list 60. The selection unit 56*a* may also output duplicate information of the candidate list 60 to the warning display control unit 62 as the positional information 64.

The warning display control unit 62 identifies the nozzle number of the forced ejection nozzle 25A based on the positional information 64 input from the selection unit 56*a*. The recording position of each of the nozzles 25 on the recording medium 12 is determined for each type of the ink-jet head 11 or each type of the recording medium 12. Therefore, the warning display control unit 62 obtains the recording position (e.g., a distance from a paper end of the recording medium 12) of the forced ejection nozzle 25A on the recording medium 12 based on the nozzle number of the forced ejection nozzle 25A and the known types of the ink-jet head 11 and the recording medium 12. The warning display control unit 62 outputs warning information 65 including the nozzle number of the forced ejection nozzle 25A and the recording position information to the UI control unit 32, and also issues a warning display command to the UI control unit 32.

The UI control unit 32 displays the warning information 65 on the screen of the monitor (a display unit) 16 upon receiving the warning display command from the warning display control unit 62. Accordingly, a user can identify that the image recording is performed by using the forced ejection nozzle 25A. Since the warning information 65 also includes the positional information (the nozzle number, the recording position from the paper end) indicating the position of the forced ejection nozzle 25A, a user can also identify the nozzle number of the forced ejection nozzle 25A (the position of the forced ejection nozzle 25A in the ink-jet head 11), and the recording position of the forced ejection nozzle 25A on the recording medium 12. Accordingly, a user can be prompted to determine OK/NG of the image quality of the recorded image.

Various display units such as an audio display unit which outputs warning information from a loudspeaker (not illustrated), that is, performs audio display may also be used instead of the monitor 16 which displays the warning information on the screen.

[Ink-Jet Printing System According to a Third Embodiment]

Next, a printing system according to a third embodiment of the presently disclosed subject matter is described. In the aforementioned embodiments, the recording densities of the adjacent nozzles 25 respectively located on both sides of the defective nozzle $25_{NG}$ (including the concentrated defective nozzles $25_{NGX}$ and the forced ejection nozzle 25A) are increased in the non-ejection correction processing. The output densities of nozzles 25 around the adjacent nozzles 25 may be further increased. The printing system according to the third embodiment has the same configuration as the printing system 10 according to the first embodiment.

Figure 19A:
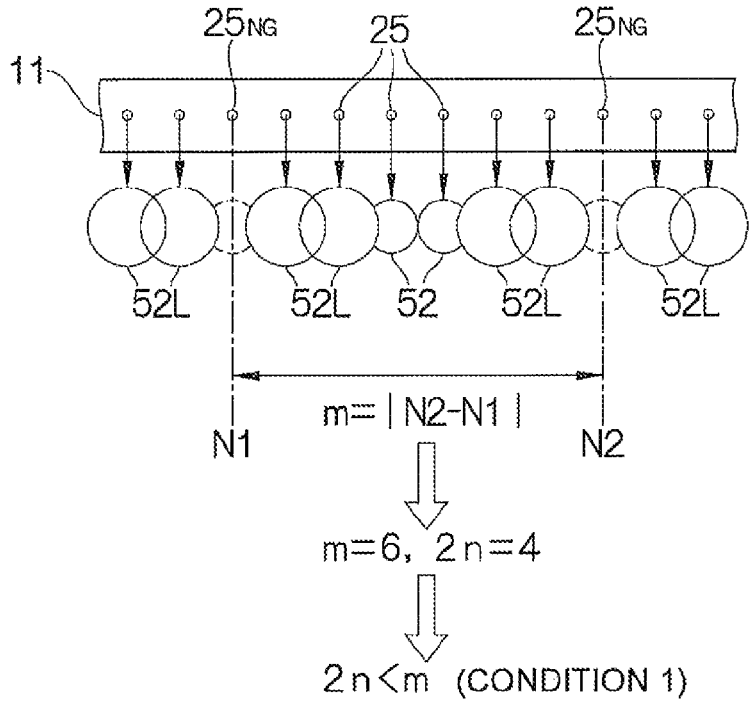
FIGS. 19A and 19B are explanatory views for explaining a process of determining generation of a correction performance non-guaranteed pattern according to a third embodiment in which the output densities of a different number of nozzles are increased in the non-ejection correction processing.

For example, as illustrated in FIG. 19A, when the output densities of two nozzles 25 located on each side of the defective nozzle $\mathbf{25}_{NG}$, i.e., a total of four nozzles 25 are increased, the single width n of the non-ejection correction interference region illustrated in FIGS. 9 and 10 is defined as "the number of correcting pixels+γ"="2+γ" in the determination unit 55. Here, γ is a margin of the non-ejection correction interference region single width, and γ=0 to 2, 3 (nozzle). The description is made based on γ=0. The determination unit 55 compares m(|N2−N1|) and 2n=4, and determines that the above condition 2n<m (the condition 1) is satisfied in a case of, for example, m=6. That is, the determination unit 55 determines that the first and second defective nozzles $\mathbf{25}_{NG}$ are sufficiently apart from each other so as not to affect the performance of each non-ejection correction processing, and the first and second defective nozzles $\mathbf{25}_{NG}$ do not fall under the concentrated defective nozzles $\mathbf{25}_{NGX}$.

Figure 19B:
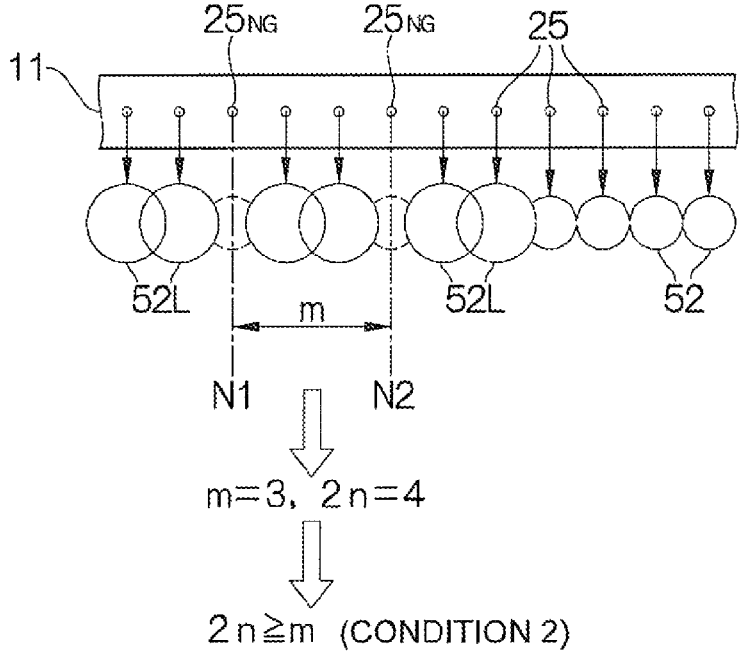

Meanwhile, as illustrated in FIG. 19B, the determination unit 55 determines that the above condition 2n≥m (the condition 2) is satisfied in a case of, for example, m=3. That is, the determination unit 55 determines that the first and second defective nozzles $\mathbf{25}_{NG}$ are adjacent to or close to each other, and the first and second defective nozzles $\mathbf{25}_{NG}$ fall under the concentrated defective nozzles $\mathbf{25}_{NGX}$.

When the output densities of three or more nozzles 25 located on each side of the defective nozzle $\mathbf{25}_{NG}$ are increased, the determination unit 55 can also determine whether or not the first and second defective nozzles $\mathbf{25}_{NG}$ fall under the concentrated defective nozzles $\mathbf{25}_{NGX}$ in the same method.

[Ink-Jet Printing System According to a Fourth Embodiment]

Next, a printing system according to a fourth embodiment of the presently disclosed subject matter is described. In the aforementioned respective embodiments, when the pattern of the defective nozzles $\mathbf{25}_{NG}$ includes a plurality of concentrated defective nozzles $\mathbf{25}_{NGX}$, the pattern is determined to fall under the non-guaranteed pattern, and the forced ejection nozzle selecting process is performed. At this point, for example, in a case in which an image design is a line drawing, the line drawing cannot be recorded when a defective nozzle $\mathbf{25}_{NG}$ for recording the line drawing is subjected to the output suspension processing. Thus, an image defect caused by the output suspension processing of the defective nozzle $\mathbf{25}_{NG}$ occurs in the recorded image. Therefore, in the fourth embodiment, when the defective nozzle $\mathbf{25}_{NG}$ excluded from the object of output suspension processing in relation to the design of the image (referred to as a special defective nozzle $\mathbf{25}_{NG}$ below) is included in the defective nozzles $\mathbf{25}_{NG}$, the pattern of the defective nozzles $\mathbf{25}_{NG}$ is determined to fall under the non-guaranteed pattern CP, and the forced ejection nozzle selecting process is performed.

The printing system according to the fourth embodiment basically has the same configuration as the printing system 10 according to the first embodiment. Therefore, components having the same functions and configurations as those of the first embodiment are assigned the same reference numerals, and the description is omitted.

The determination unit 55 according to the fourth embodiment analyzes the design of the image recorded on the recording medium 12 by reference to the image data 18 in addition to execution of the determining process described in the first embodiment. The design may be analyzed in another unit such as the printing process control unit 30, and the analysis result may be input into the determination unit 55. When the special defective nozzle $\mathbf{25}_{NG}$ for recording the line drawing or the like is included in the defective nozzles $\mathbf{25}_{NG}$ detected in the defective nozzle detecting process, the determination unit 55 determines that the pattern of the defective nozzles $\mathbf{25}_{NG}$ falls under the non-guaranteed pattern CP.

The selection unit 56 according to the fourth embodiment selects the special defective nozzle $\mathbf{25}_{NG}$ as the forced ejection nozzle 25A in the forced ejection nozzle selecting process.

<Operation of the Printing System According to the Fourth Embodiment>

Figure 20:
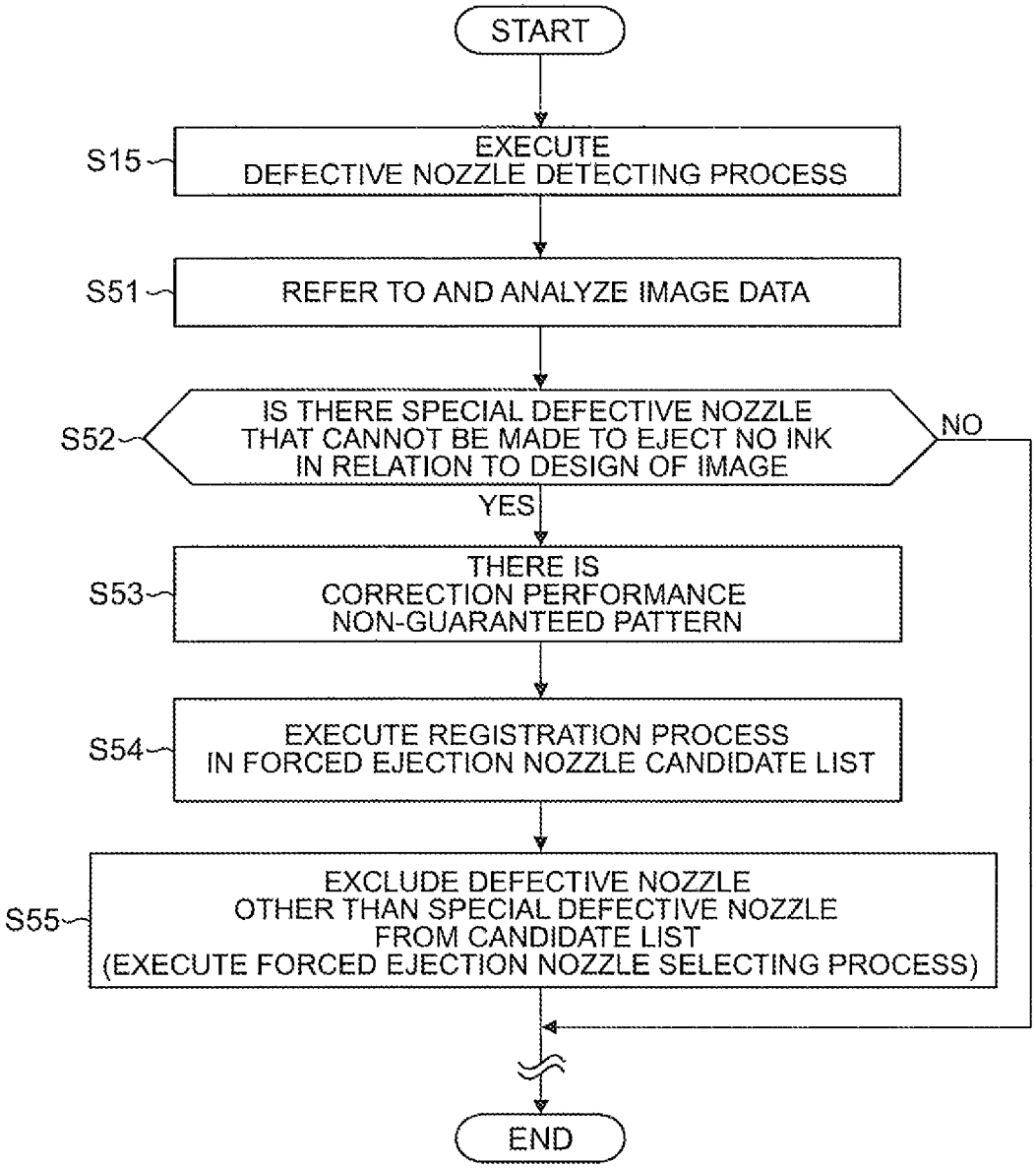
FIG. 20 is a flowchart for explaining the operation of an ink-jet printing system according to a fourth embodiment (a process of determining generation of a correction performance non-guaranteed pattern, and a process of selecting a forced ejection nozzle)
Figure 21:
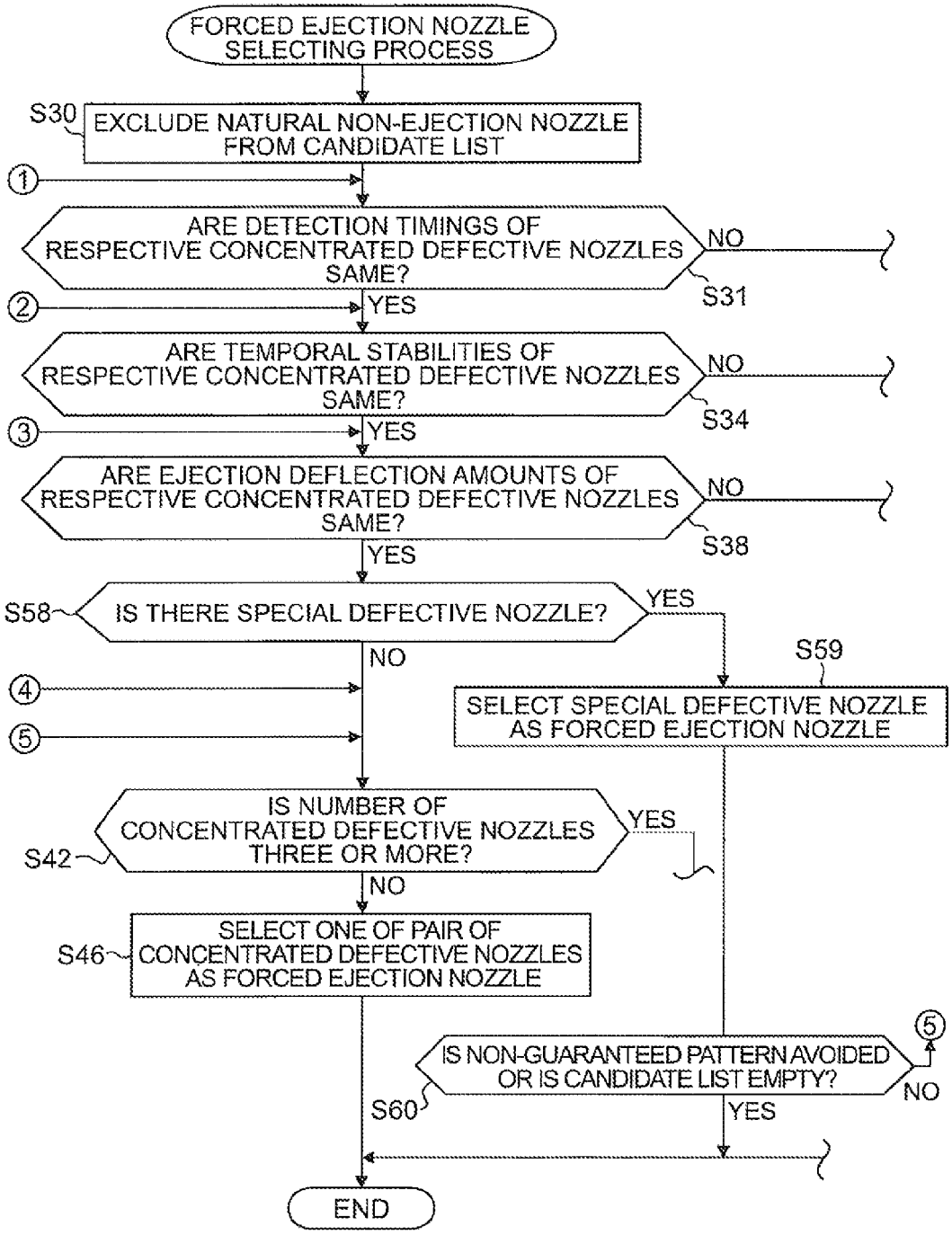
FIG. 21 is a flowchart for explaining another embodiment of the fourth embodiment.

The operation of the printing system according to the fourth embodiment having the aforementioned configuration is described by using FIG. 20. Since the defective nozzle detecting process (step S15) is the same as that of the first embodiment, the description is omitted. Here, a case in which the concentrated defective nozzles $\mathbf{25}_{NGX}$ are not included in the defective nozzles $\mathbf{25}_{NG}$ is described so as not to complicate the description.

After completion of the defective nozzle detecting process, the determination unit 55 analyzes the design of the image recorded on the recording medium 12 by reference to the image data 18 (step S51). Subsequently, the determination unit 55 determines whether or not the special defective nozzle $\mathbf{25}_{NG}$ is included in the defective nozzles $\mathbf{25}_{NG}$ detected in the defective nozzle detecting process based on the analysis result of the design and the defective nozzle information in the defective nozzle information table 50 within the data storage unit 28. The determination unit 55 determines whether or not the non-guaranteed pattern CP is generated based on whether the special defective nozzle $\mathbf{25}_{NG}$ is included, and outputs the determination result to the selection unit 56 (step S52, a determination step). The determination unit 55 also reads out the nozzle number of the special defective nozzle $\mathbf{25}_{NG}$ included in the non-guaranteed pattern from the defective nozzle information table 50 when the non-guaranteed pattern CP is generated, and outputs the nozzle number to the selection unit 56. Since the process when the non-guaranteed pattern CP is not generated (NO in step S52) is the same as that of the first embodiment, the description is omitted.

When the determination result indicating that the non-guaranteed pattern CP is generated is input from the determination unit 55 (YES in step S52, step S53), the selection unit 56 registers the nozzle number of the special defective nozzle $\mathbf{25}_{NG}$ input from the determination unit 55 in the candidate list 60 (step S54). Subsequently, the selection unit 56 selects the special defective nozzle $\mathbf{25}_{NG}$ registered in the candidate list 60 as the forced ejection nozzle 25A, and outputs the candidate list 60 to the non-ejection correction processing unit 57 (step S55). Since the subsequent processes are basically the same as those of the first embodiment (step S19 to step S27) illustrated in FIG. 13, the specific description is omitted.

<Operation Effect of the Printing System According to the Fourth Embodiment>

By selecting the special defective nozzle $\mathbf{25}_{NG}$ as the forced ejection nozzle 25A as described above, the ink 52A can be ejected from the special defective nozzle $\mathbf{25}_{NG}$ which cannot be subjected to the output suspension processing in relation to the design of the image to perform the image recording. Accordingly, the image quality of the recorded image can be improved as compared to a case in which the special defective nozzle $\mathbf{25}_{NG}$ is subjected to the output suspension processing.

<Another Embodiment of the Fourth Embodiment>

The printing system according to the above fourth embodiment and the printing systems according to the aforementioned first to third embodiments may be combined as appropriate. For example, when the special defective nozzle $25_{NG}$ is included in the concentrated defective nozzles $25_{NGX}$ after it is determined to be YES in step S38 (YES in step S58), the special defective nozzle $25_{NG}$ is preferentially selected as the forced ejection nozzle 25A (step S59). The selection unit 56 terminates the selecting process when the remaining concentrated defective nozzles $25_{NGX}$ no longer constitute the non-guaranteed pattern CP (that is, when the non-guaranteed pattern CP is avoided), or when the candidate list 60 is empty (YES in step S60). When determining NO in step S60, the selection unit 56 executes the processing of step S42 to step S46 described above (see FIG. 16).

[Configuration Example of Another Ink-Jet Printer]

Next, a configuration example of a printer 100 as an example of the printer 13 illustrated in FIG. 1 is described.

Figure 22:
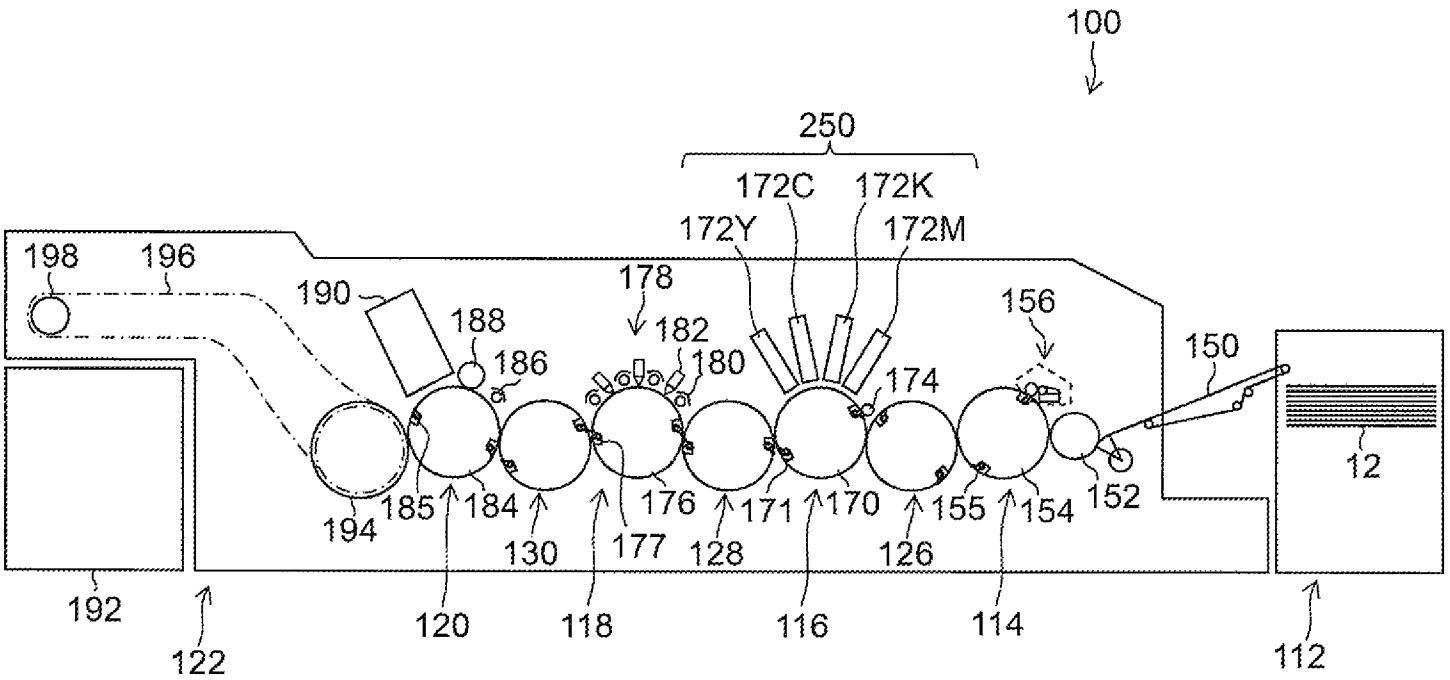
FIG. 22 is a schematic view of an ink-jet printer according to another example.

As illustrated in FIG. 22, the printer 100 is an ink-jet printer employing a direct image formation method, which forms a desired color image by depositing ink of a plurality of colors on the recording medium 12 held on a drawing drum 170 from a recording head 250 (composed of ink-jet heads 172M, 172K, 172C, and 172Y for the colors of CMYK), and is an ink-jet printer employing a two-liquid reaction (aggregation) method in which an image is formed on the recording medium 12 by applying a treatment liquid (here, an aggregating treatment liquid) onto the recording medium 12 before deposition of the ink, and causing a reaction between the treatment liquid and the ink liquid.

The printer 100 mainly includes a paper feed unit 112, a treatment liquid application unit 114, a recording unit 116, a drying unit 118, a fixing unit 120, and a paper discharge unit 122.

(Paper Feed Unit)

The recording media 12 as sheets of paper are stacked in the paper feed unit 112. The recording media 12 are fed to the treatment liquid application unit 114 one by one from a paper feed tray 150 of the paper feed unit 112. Although the sheets of paper (cut sheets of paper) are used as the recording medium 12, a configuration in which paper is fed by cutting a continuous roll of paper (rolled paper) into a necessary size may also be employed.

(Treatment Liquid Application Unit)

The treatment liquid application unit 114 is a mechanism which applies the treatment liquid to the surface of the recording medium 12. The treatment liquid contains a coloring material aggregating agent which aggregates a coloring material (a pigment in the present embodiment) in the ink applied by the recording unit 116. When the treatment liquid and the ink come into contact with each other, the coloring material and a solvent in the ink are prompted to be separated.

The treatment liquid application unit 114 includes a paper feed cylinder 152, a treatment liquid drum 154, and a treatment liquid application device 156. The treatment liquid drum 154 includes a hook-like holding device (a gripper) 155 on an outer peripheral surface thereof. By sandwiching the recording medium 12 between the hook of the holding device 155 and the peripheral surface of the treatment liquid drum 154, a distal end of the recording medium 12 can be held. A suction hole may be provided in the outer peripheral surface of the treatment liquid drum 154, and a suction device which performs suction from the suction hole may be connected thereto. Accordingly, the recording medium 12 can be adhesively held on the peripheral surface of the treatment liquid drum 154.

The treatment liquid application device 156 is arranged facing the peripheral surface of the treatment liquid drum 154. The treatment liquid application device 156 includes a treatment liquid vessel in which the treatment liquid is stored, an anilox roller which is partially immersed in the treatment liquid in the treatment liquid vessel, and a rubber roller which is in pressure contact with the anilox roller and the recording medium 12 on the treatment liquid drum 154 to move a dosed amount of treatment liquid onto the recording medium 12. The treatment liquid application device 156 can apply the treatment liquid to the surface of the recording medium 12 while dosing the amount of treatment liquid. Although an application method using the roller is described as an example in the present embodiment, the presently disclosed subject matter is not limited thereto. For example, various methods such as spray method and ink-jet method may be employed.

The recording medium 12 to which the application liquid has been applied is transferred to the drawing drum 170 of the recording unit 116 via an intermediate conveyance unit 126 from the treatment liquid drum 154.

(Recording Unit)

The recording unit 116 includes the drawing drum 170, a paper pressing roller 174, and an ink-jet head 250 (ink-jet heads 172M, 172K, 172C, and 172Y). The drawing drum 170 includes a hook-like holding device (a gripper) 171 on an outer peripheral surface thereof similarly to the treatment liquid drum 154.

The ink-jet heads 172M, 172K, 172C, and 172Y are ink-jet heads of full-line ink-jet-type having a length corresponding to the maximum width of an image formation region of the recording medium 12. A nozzle line in which a plurality of ink-ejecting nozzles are arranged over the entire width of the image formation region is formed on each of the nozzle ejection surfaces. The respective ink-jet heads 172M, 172K, 172C, and 172Y are arranged so as to extend in a direction (a first direction) perpendicular to the conveyance direction of the recording medium 12 (a rotating direction of the drawing drum 170, a second direction).

When the respective ink-jet heads 172M, 172K, 172C, and 172Y of the ink-jet head 250 arranged on the surface side of the recording medium 12 eject droplets of the corresponding colored ink toward the surface of the recording medium 12 adhesively held on the drawing drum 170, the treatment liquid applied to the recording surface in advance in the treatment liquid application unit 114 and the ink come into contact with each other. The coloring material (the pigment) dispersed in the ink is thereby aggregated to form a coloring material aggregate. Accordingly, movement of the coloring material on the recording medium 12 or the like is prevented. An image is formed on the surface of the recording medium 12.

That is, the image can be recorded on the image formation region on the surface of the recording medium 12 by performing only once an operation of conveying the recording medium 12 by the drawing drum 170 at constant speed, and relatively moving the recording medium 12 and the respective ink-jet heads 172M, 172K, 172C, and 172Y with respect to the conveyance direction (that is, only one sub-scanning operation).

The recording medium 12 on which the image has been formed is transferred to a drying drum 176 of the drying unit 118 via an intermediate conveyance unit 128 from the drawing drum 170.

(Drying Unit)

The drying unit 118 is a mechanism which dries water contained in the solvent separated by the coloring material aggregating action. The drying unit 118 includes the drying drum 176, and a solvent drying device 178. The drying drum 176 includes a hook-like holding device (a gripper) 177 on an outer peripheral surface thereof similarly to the treatment liquid drum 154. The distal end of the recording medium 12 can be held by the holding device 177.

The solvent drying device 178 is arranged at a position facing the outer peripheral surface of the drying drum 176. The solvent drying device 178 includes a plurality of halogen heaters 180, and a hot air spraying nozzle 182 arranged between the respective halogen heaters 180. The recording medium 12 subjected to dry processing in the drying unit 118 is transferred to a fixing drum 184 of the fixing unit 120 via an intermediate conveyance unit 130 of the drying drum 176.

(Fixing Unit)

The fixing unit 120 includes the fixing drum 184, a halogen heater 186, a fixing roller 188, and an in-line sensor 190. The fixing drum 184 includes a hook-like holding device (a gripper) 185 on an outer peripheral surface thereof similarly to the treatment liquid drum 154. The distal end of the recording medium 12 can be held by the holding device 185.

When the fixing drum 184 is rotated, preliminary heating by the halogen heater 186, fixing by the fixing roller 188, and inspection by the in-line sensor 190 are performed on the recording surfaces (both surfaces) of the recording medium 12.

The fixing roller 188 is a roller member which melts and fixes self-dispersible polymer fine particles in the ink by heating and pressurizing the dried ink, and thereby forms the ink into a film. The fixing roller 188 is configured to heat and pressurize the recording medium 12. To be more specific, the fixing roller 188 is arranged so as to be in pressure contact with the fixing drum 184, and constitutes a nip roller with the fixing drum 184. Accordingly, the recording medium 12 is sandwiched between the fixing roller 188 and the fixing drum 184, nipped under a predetermined nip pressure, and thereby subjected to the fixing process.

The fixing roller 188 is composed of a heating roller in which a halogen lamp or the like is incorporated. The fixing roller 188 is controlled at a predetermined temperature.

The in-line sensor 190 is a device which reads the image formed on the recording medium 12 to detect the density of the image, a flaw in the image, or the like. A CCD line sensor or the like is employed. The in-line sensor 190 is basically the same as the above in-line sensor 21.

In the fixing unit 120, latex particles in a thin image layer formed by the drying unit 118 are heated, pressurized, and melted by the fixing roller 188, so that the image layer can be fixed to the recording medium 12. The surface temperature of the fixing drum 184 is set to 50° C. or more.

Ink containing a monomer component which can be polymerized and cured by exposure to UV light may be employed instead of the ink containing a high-boiling solvent and polymer fine particles (thermoplastic resin particles). In this case, the printer 100 includes a UV exposure unit which exposes the ink on the recording medium 12 to UV light instead of the heat-pressure fixing unit (the fixing roller 188) using the heat roller. When the ink containing active light-curable resin such as the UV-curable resin is used, a device which emits active light, such as a UV lamp and an ultraviolet LD (laser diode) array, is provided instead of the heat fixing roller 188.

(Paper Discharge Unit)

The paper discharge unit 122 is provided subsequent to the fixing unit 120. The paper discharge unit 122 includes a discharge tray 192. A transfer cylinder 194, a conveyance belt 196, and a tension roller 198 are provided between the discharge tray 192 and the fixing drum 184 of the fixing unit 120 so as to face the discharge tray 192 and the fixing drum 184 of the fixing unit 120. The recording medium 12 is sent to the conveyance belt 196 by the transfer cylinder 194, and discharged to the discharge tray 192. Although a paper conveying mechanism using the conveyance belt 196 is not illustrated in detail, a paper distal end portion of the recording medium 12 after printing is held by a gripper of a bar (not illustrated) suspended between the endless conveyance belts 196, and the recording medium 12 is conveyed to above the discharge tray 192 by the rotation of the conveyance belt 196.

Although not illustrated in the drawings, the printer 100 in the present embodiment includes an ink storage/loading unit which supplies ink to the respective ink jet heads 172M, 172K, 172C, and 172Y, a device which supplies the treatment liquid to the treatment liquid application unit 114, a head maintenance unit which cleans (wiping of the nozzle surface, purging, nozzle suction or the like) the respective ink-jet heads 172M, 172K, 172C, and 172Y, a position detection sensor which detects the position of the recording medium 12 in the paper conveyance path, and a temperature sensor which detects the temperature of the respective units of the apparatus in addition to the above configuration.

[Structure of the Ink-Jet Head]

Next, the structure of the ink-jet heads 172M, 172K, 172C and 172Y provided on the recording unit 116 is described. Since the ink-jet heads 172M, 172K, 172C and 172Y corresponding to the respective colors have a common structure, these heads are represented by the ink-jet head 250 in the following description.

Figure 23:
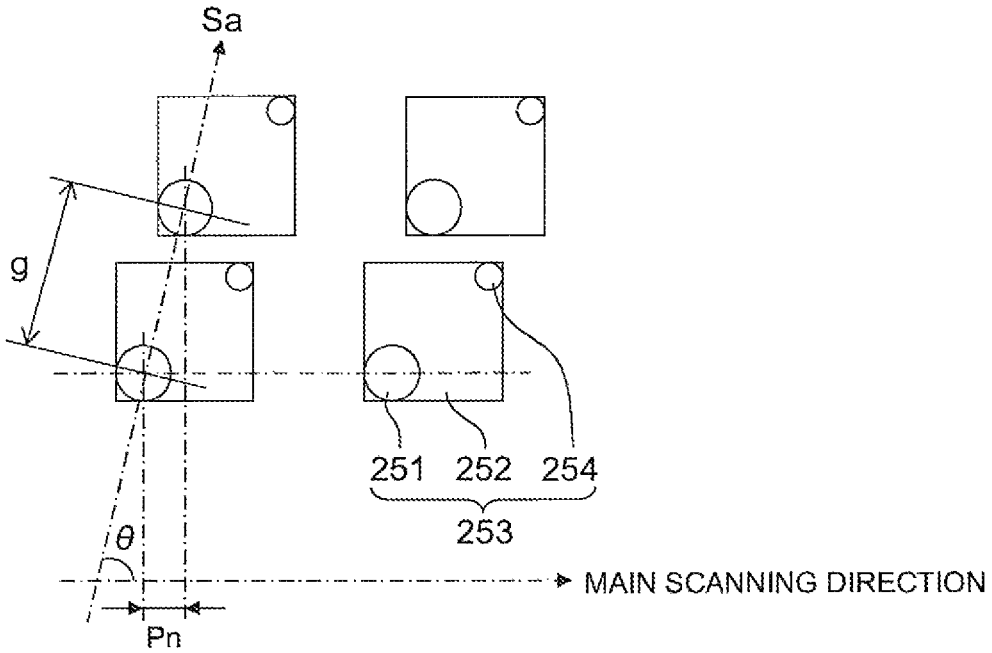
FIG. 23 is a schematic view illustrating a configuration example of an ink-jet head.

As illustrated in FIG. 23, the ink-jet head 250 has a structure in which a plurality of ink chamber units (droplet ejection elements as a unit of the recording element) 253 each including a nozzle 251 as an ink ejection port, and a pressure chamber 252 in communication with each nozzle 251, and a supply port 254 that brings a common flow channel (not illustrated) and each pressure chamber 252 into communication are arranged in matrix. Accordingly, a high density is achieved in an effective nozzle pitch (a projected nozzle pitch in the drawing designated by reference character Pn) obtained by projecting the nozzles to be aligned in a main scanning direction as a longitudinal direction of the ink-jet head 250.

Each pressure chamber 252 in communication with the nozzle 251 has a substantially square planar shape. The nozzle 251 is arranged in one of two corner portions on a diagonal line, and the supply port 254 is arranged in the other. The shape of the pressure chamber 252 is not limited to that of the present embodiment and various modes in which the planar shape is a quadrangular shape (rhombic shape, rectangular shape, or the like), a pentagonal shape, a hexagonal shape, or other polygonal shapes, a circular shape, an elliptical shape, or the like may be employed.

The high-density nozzle head of the present embodiment is achieved by arranging the ink chamber units 253 each including the nozzle 251, the pressure chamber 252 and the like in matrix according to a given arrangement pattern in a row direction along the main scanning direction (designated by reference character M) and an oblique column direction (designated by reference character Sa) having a given non-perpendicular angle $\theta$ ($0° < \theta < 90°$) with respect to the main scanning direction.

That is, according to the structure in which the plurality of ink chamber units 253 are arranged at a uniform pitch g in the direction having a given angle $\theta$ with respect to the main scanning direction, the projected nozzle pitch Pn obtained by projecting the nozzles to be arranged in the main scanning direction is $g \times \cos\theta$. As for the main scanning direction, the arrangement can be treated as equivalent to a configuration where the respective nozzles 251 are arranged linearly at a uniform pitch of Pn. In accordance with the configuration, high-density arrangement in which a nozzle column obtained by projecting the nozzles to be arranged in the main scanning direction has as much as 1,200 nozzles per inch (1,200 nozzle/inch) can be achieved.

Figure 24:
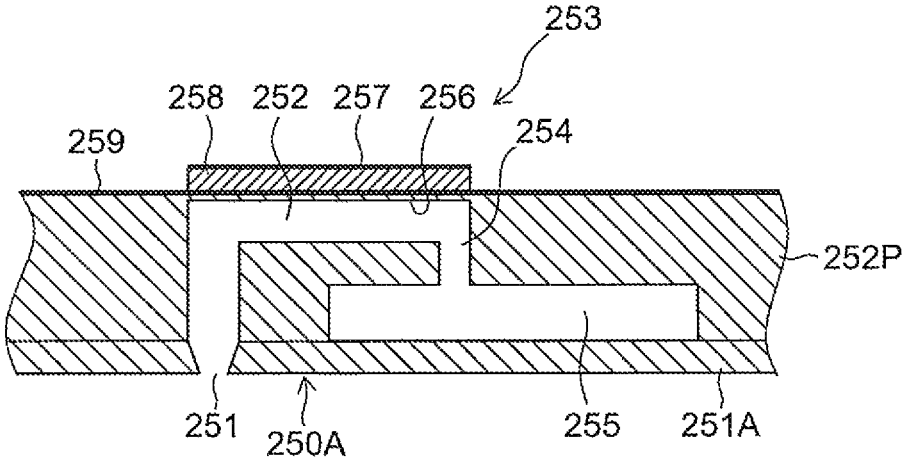
FIG. 24 is a sectional view of the ink-jet head.

As illustrated in FIG. 24, the ink-jet head 250 has a structure in which a nozzle plate 251A in which the nozzles 251 are formed, a flow channel plate 252P in which flow channels such as the pressure chambers 252 and a common flow channel 255 are formed, and so on, are layered and bonded together.

The flow channel plate 252P is a flow channel forming member which constitutes side wall portions of the pressure chambers 252 and in which the supply port 254 is formed to serve as a restricting portion (most constricted portion) of an individual supply channel for guiding ink to the pressure chamber 252 from the common flow channel 255. Although a simplified view is given in FIG. 24 for the convenience of description, the flow channel plate 252P has a structure formed by layering one or a plurality of substrates together.

The nozzle plate 251A and the flow channel plate 252P can be processed into a desired shape by a semiconductor manufacturing process using silicon as a material.

The common flow channel 255 communicates with an ink tank (not illustrated) as an ink supply source. The ink supplied from the ink tank is supplied through the common flow channel 255 to the respective pressure chambers 252.

A piezoelectric actuator 258 including an individual electrode 257 is bonded to a vibration plate 256 that constitutes a portion of the surface of the pressure chamber 252 (the ceiling in FIG. 24). The vibration plate 256 in the present embodiment is made of silicon (Si) having a nickel (Ni) conducting layer, which functions as a common electrode 259 corresponding to a lower electrode of the piezoelectric actuator 258, and serves as a common electrode for the piezoelectric actuator 258 which is arranged corresponding to each of the pressure chambers 252. A mode in which the vibration plate is made from a non-conductive material such as resin may also be employed. In this case, a common electrode layer made of a conductive material such as metal is formed on the surface of the vibration plate member. Furthermore, the vibration plate which also serves as the common electrode can be made of metal (conductive material) such as stainless steel (SUS).

When a drive voltage is applied to the individual electrode 257, the piezoelectric actuator 258 deforms, thereby changing the volume of the pressure chamber 252. A pressure change is thereby caused, so that the ink is ejected from the nozzle 251. When the piezoelectric actuator 258 returns to its original position after the ink ejection, the pressure chamber 252 is filled again with new ink from the common flow channel 255 through the supply port 254.

Although the printer 100 to which a pressure-cylinder conveyance method is applied is described in the present embodiment, the conveyance method of the recording medium 12 is not limited to the pressure-cylinder conveyance method. A belt conveyance method in which the recording medium 12 is conveyed while being adhesively held on a conveyance belt, or another conveyance method may also be employed.

The mode of arrangement of the nozzles 251 is not limited to the embodiment illustrated in the drawings, and it is possible to adopt various nozzle arrangement structures. For example, it is possible to use a single line linear nozzle arrangement, a V-shaped nozzle arrangement, or a broken line nozzle arrangement such as a zig-zag shape (W shape, or the like) in which a V-shaped nozzle arrangement is repeated.

[Others]

Although the process of determining the generation of the non-guaranteed pattern and the process of selecting the forced ejection nozzle are performed in the printer 13 in the aforementioned embodiments, at least one of the processes may be performed in the PC 14. The presently disclosed subject matter may also be applied to an image recording apparatus in which the printer 13 and the PC 14 are integrally formed.

Although the description is made by using the "ejection largely-deflected nozzle" as an example of the defective nozzle $\mathbf{25}_{NG}$ that can be selected as the forced ejection nozzle 25A in the aforementioned embodiments, the type of defects is not particularly limited as long as the defective nozzle $\mathbf{25}_{NG}$ can at least eject the ink 52.

Although the ink-jet head according to the above embodiments records the four colors of CMYK, the recorded color is not particularly limited. The presently disclosed subject matter may also be applied to an ink-jet printer including an ink-jet head of, for example, shuttle head type which moves a recording head with respect to a recording medium instead of moving the recording medium with respect to the fixed ink-jet head.

In the aforementioned respective embodiments, the description is made based on the example in which the presently disclosed subject matter is applied to an ink-jet printer for graphic printing. However, the applicable range of the presently disclosed subject matter is not limited to the example. For example, the presently disclosed subject matter can be widely applied to an ink-jet printer which draws various shapes or patterns by using a liquid functional material, such as a wiring drawing apparatus which draws a wiring pattern of an electronic circuit, various device production apparatuses, a resist printing apparatus which uses a resin liquid as a functional liquid for ejection, a color filter production apparatus, and a fine structure forming apparatus which forms a fine structure by using a material for material deposition.

Although the ink-jet printer is described as an example of the image recording apparatus of the presently disclosed subject matter in the aforementioned respective embodiments, the presently disclosed subject matter can be applied to various image recording apparatuses such as a thermal transfer recording apparatus including a plurality of recording heads where a thermal element serves as a recording element, and an LED electrophotographic printer including a plurality of recording heads where an LED element serves as a recording element.

The presently disclosed subject matter can be provided as a computer-readable program code for causing a device to execute the above described process, a non-transitory computer-readable recording medium on which the computer-readable program code is stored or a computer program product storing executable code for the method.

What is claimed is:

1. An image recording apparatus comprising:

a recording control unit configured to record an image on a recording medium by a recording head having a plurality of recording elements while relatively moving the recording head and the recording medium;

a defective recording element detection unit configured to detect a defective recording element out of the plurality of recording elements;

a correction processing unit configured to perform a correction processing including suspension of an output of the defective recording element and increase of an output of a recording element at least adjacent to the defective recording element according to a detection result of the defective recording element detection unit;

a determination unit configured to determine whether or not an image defect is caused in the image by the suspension of output of the defective recording element, before the correction processing by the correction processing unit, according to the detection result of the defective recording element detection unit;

a selection unit configured to select a forced recording element that is forced to output ink out of defective recording elements detected by the defective recording element detection unit when the determination unit determines that the image defect is caused; and a control unit configured to cause the correction processing unit to suspend an output of the defective recording element other than the forced recording element when the selection unit selects the forced recording element.

2. The image recording apparatus according to claim 1, further comprising a display unit configured to display warning information indicating that image recording is performed by the forced recording element when the selection unit selects the forced recording element.

3. The image recording apparatus according to claim 2, wherein the warning information includes positional information indicating a position of the forced recording element in the recording head.

4. The image recording apparatus according to claim 1, wherein the determination unit determines whether or not the image defect is caused based on whether a pattern of the defective recording elements detected by the defective recording element detection unit falls under a correction performance non-guaranteed pattern in which the image defect is caused, and the selection unit selects the forced recording element out of the defective recording elements based on a predetermined forced recording element selection rule.

5. The image recording apparatus according to claim 4, wherein when the defective recording element excluded from an object of the suspension of output according to a design of the image is included in the defective recording elements, the determination unit determines that the pattern of the defective recording elements falls under the correction performance non-guaranteed pattern, and in the forced recording element selection rule, the defective recording element excluded from the object of the suspension of output according to the design is selected as the forced recording element.

6. The image recording apparatus according to claim 4, wherein the determination unit determines that the pattern of the defective recording elements falls under the correction performance non-guaranteed pattern when a plurality of concentrated defective recording elements, recording positions of which on the recording medium are adjacent to or close to each other, are included in the defective recording elements.

7. The image recording apparatus according to claim 6, wherein when a distance between a first defective recording element and a second defective recording element included in the defective recording elements is m, and a range in which a correction processing corresponding to one of the first defective recording element and the second defective recording element by the correction processing unit affects a correction processing corresponding to another of the first defective recording element and the second defective recording element is n, the determination unit determines that the first defective recording element and the second defective recording element in a positional relationship satisfying $2n \geq m$ are the concentrated defective recording elements.

8. The image recording apparatus according to claim 6, further comprising a storage unit configured to store the detection result of the defective recording element detection unit, wherein the selection unit selects the forced recording element based on the detection result stored in the storage unit and the forced recording element selection rule.

9. The image recording apparatus according to claim 8, wherein the detection result includes information indicating detection timings of the defective recording elements, and in the forced recording element selection rule, one detected later out of a first concentrated defective recording element and a second concentrated defective recording element included in the respective concentrated defective recording elements is preferentially selected as the forced recording element.

10. The image recording apparatus according to claim 8, wherein the recording elements eject ink, and when ejection deflection of the ink occurs in the defective recording elements, the detection result includes information indicating temporal stabilities of magnitudes of the ejection deflection of the defective recording elements, and in the forced recording element selection rule, one, the magnitude of the ejection deflection of which has a higher temporal stability, out of a first concentrated defective recording element and a second concentrated defective recording element included in the respective concentrated defective recording elements is preferentially selected as the forced recording element.

11. The image recording apparatus according to claim 8, wherein the recording elements eject ink, and when ejection deflection of the ink occurs in the defective recording elements, the detection result includes information indicating magnitudes of the ejection deflection of the defective recording elements, and in the forced recording element selection rule, one having a smaller magnitude of the ejection deflection out of a first concentrated defective recording element and a second concentrated defective recording element included in the respective concentrated defective recording elements is preferentially selected as the forced recording element.

12. The image recording apparatus according to claim 8, wherein the recording elements eject ink, and when the defective recording elements include a defective recording element which cannot eject the ink and a defective recording element in which ejection deflection of the ink occurs, the detection result includes information indicating types of the defective recording elements, information indicating detection timings of the defective recording elements, and information indicating a magnitude of the ejection deflection of the defective recording element in which the ejection deflection occurs and a temporal stability thereof, and the forced recording element selection rule includes a first selection rule that the concentrated defective recording element in which the ejection deflection occurs out of the respective concentrated defective recording elements is preferentially selected as the forced recording element, a second selection rule that when the ejection deflection occurs in a plurality of concentrated defective recording elements, one detected later out of a first concentrated defective recording element and a second concentrated defective recording element included therein is preferentially selected as the forced recording element, a third selection rule that when detection timings of the first concentrated defective recording element and the second concentrated defective recording element are same, one, the magnitude of the ejection deflection of which has a higher temporal stability, is preferentially selected as the forced recording element, and a fourth selection rule that when the temporal stabilities are same, one having a smaller magnitude of the ejection deflection is preferentially selected as the forced recording element.

13. A method for controlling an image recording apparatus, the method comprising:

a defective recording element detection step of detecting a defective recording element out of a plurality of recording elements on a recording head for recording an image on a recording medium;

a correction processing step of performing a correction processing including suspension of an output of the defective recording element and increase of an output of a recording element at least adjacent to the defective recording element according to a detection result in the defective recording element detection step;

a determination step of determining whether or not an image defect is caused in the image by the suspension of output of the defective recording element, before the correction processing step, according to the detection result in the defective recording element detection step;

a selection step of selecting a forced recording element that is forced to output ink out of defective recording elements detected in the defective recording element detection step when it is determined that the image defect is caused in the determination step; and a control step of suspending an output of the defective recording element other than the forced recording element in the correction processing step when the forced recording element is selected in the selection step.

14. A non-transitory computer-readable recording medium including instructions stored thereon, such that when the instructions are read and executed by a processor, the processor is configured to perform the steps of:

a defective recording element detection step of detecting a defective recording element out of a plurality of recording elements by acquiring a reading result of a test chart from a test chart reading unit configured to read the test chart recorded on a recording medium by a recording head having the plurality of recording elements;

a correction processing step of performing a correction processing including suspension of an output of the defective recording element and increase of an output of a recording element at least adjacent to the defective recording element according to a detection result in the defective recording element detection step;

a determination step of determining whether or not an image defect is caused in the image by the suspension of output of the defective recording element, before the correction processing step, according to the detection result in the defective recording element detection step;

a selection step of selecting a forced recording element that is forced to output ink out of defective recording elements detected in the defective recording element detection step when it is determined that the image defect is caused in the determination step; and a control step of suspending an output of the defective recording element other than the forced recording element in the correction processing step when the forced recording element is selected in the selection step.

* * * * *